US011410803B2

(12) United States Patent
Brueck et al.

(10) Patent No.: US 11,410,803 B2
(45) Date of Patent: Aug. 9, 2022

(54) MAGNETOCALORIC MATERIALS COMPRISING MANGANESE, IRON, SILICON, PHOSPHORUS AND CARBON

(71) Applicant: BASF SE, Ludwigshafen am Rhein (DE)

(72) Inventors: Ekkehard Brueck, Delft (NL); Xue-Fei Miao, Utrecht (NL); Van Thang Nguyen, Utrecht (NL)

(73) Assignee: Technische Universiteit Delft, Delft (NL)

( * ) Notice: Subject to any disclaimer, the term of this patent is extended or adjusted under 35 U.S.C. 154(b) by 730 days.

(21) Appl. No.: 16/307,264

(22) PCT Filed: Jun. 8, 2017

(86) PCT No.: PCT/EP2017/063901
§ 371 (c)(1),
(2) Date: Dec. 5, 2018

(87) PCT Pub. No.: WO2017/211921
PCT Pub. Date: Dec. 14, 2017

(65) Prior Publication Data

US 2019/0304637 A1 Oct. 3, 2019

(30) Foreign Application Priority Data

Jun. 10, 2016 (EP) ..... 16173919

(51) Int. Cl.
*H01F 1/01* (2006.01)
*H01F 41/00* (2006.01)

(52) U.S. Cl.
CPC ..... *H01F 1/017* (2013.01); *H01F 1/015* (2013.01); *H01F 41/00* (2013.01)

(58) Field of Classification Search
None
See application file for complete search history.

(56) References Cited

U.S. PATENT DOCUMENTS

2011/0037342 A1* 2/2011 Degen ..... H01L 37/04 310/306
2011/0167837 A1 7/2011 Reesink et al.
2011/0220838 A1 9/2011 Brueck et al.
2016/0017462 A1 1/2016 Samanta et al.

FOREIGN PATENT DOCUMENTS

EP 0493019 A2 7/1992
EP 0493019 A3 7/1992
EP 2422347 2/2012
(Continued)

OTHER PUBLICATIONS

International Search Report dated Aug. 8, 2017, in PCT/EP2017/063901, filed Jun. 8, 2017.
(Continued)

*Primary Examiner* — Anthony M Liang
(74) *Attorney, Agent, or Firm* — Oblon, McClelland, Maier & Neustadt, L.L.P.

(57) ABSTRACT

Described are magnetocaloric materials comprising manganese, iron, phosphorus, silicon, carbon and optionally one or both of nitrogen and boron, and processes for producing said magnetocaloric materials.

14 Claims, 13 Drawing Sheets

(56) References Cited

FOREIGN PATENT DOCUMENTS

Figure 1A:
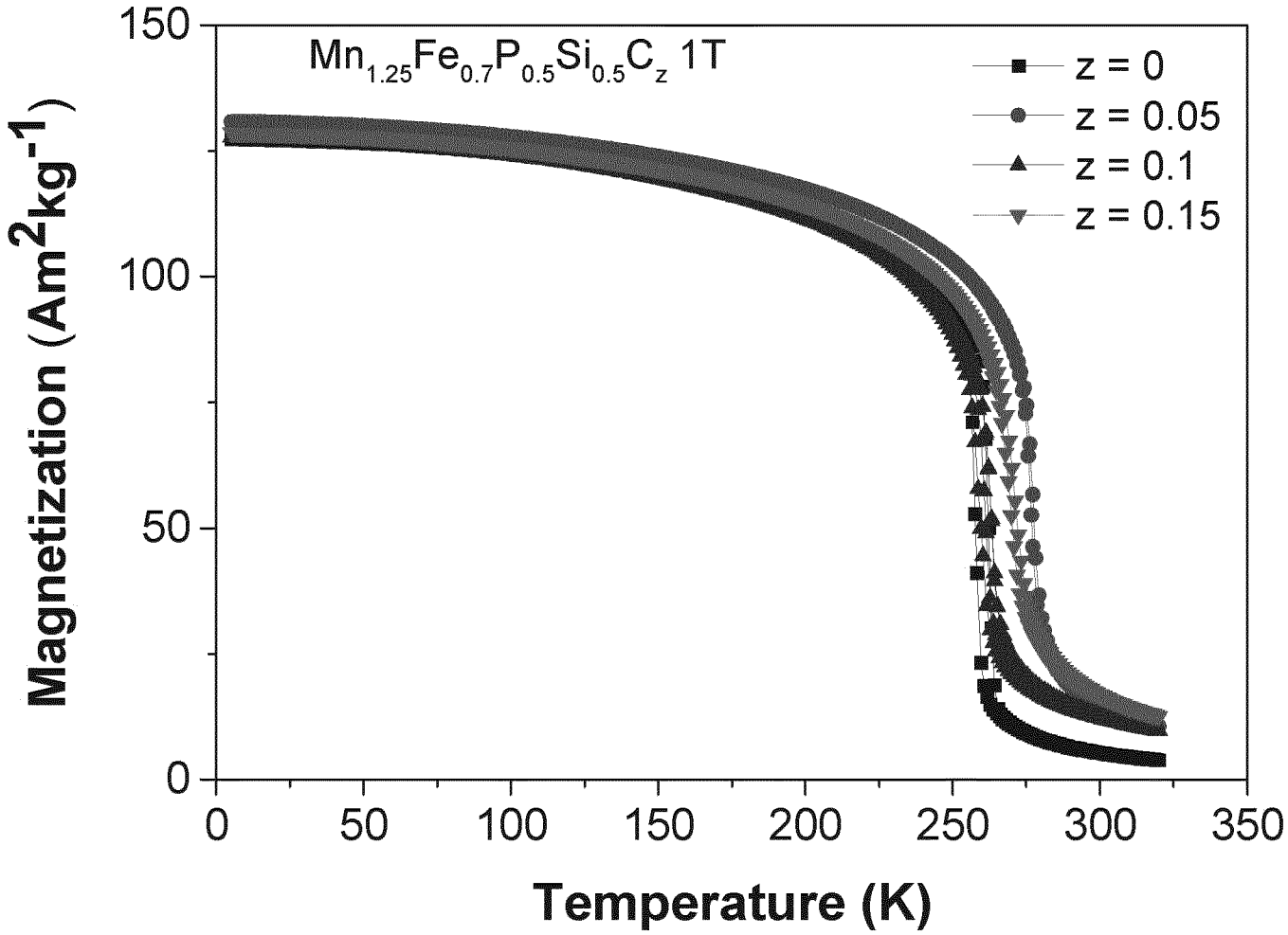
Figure 1B:
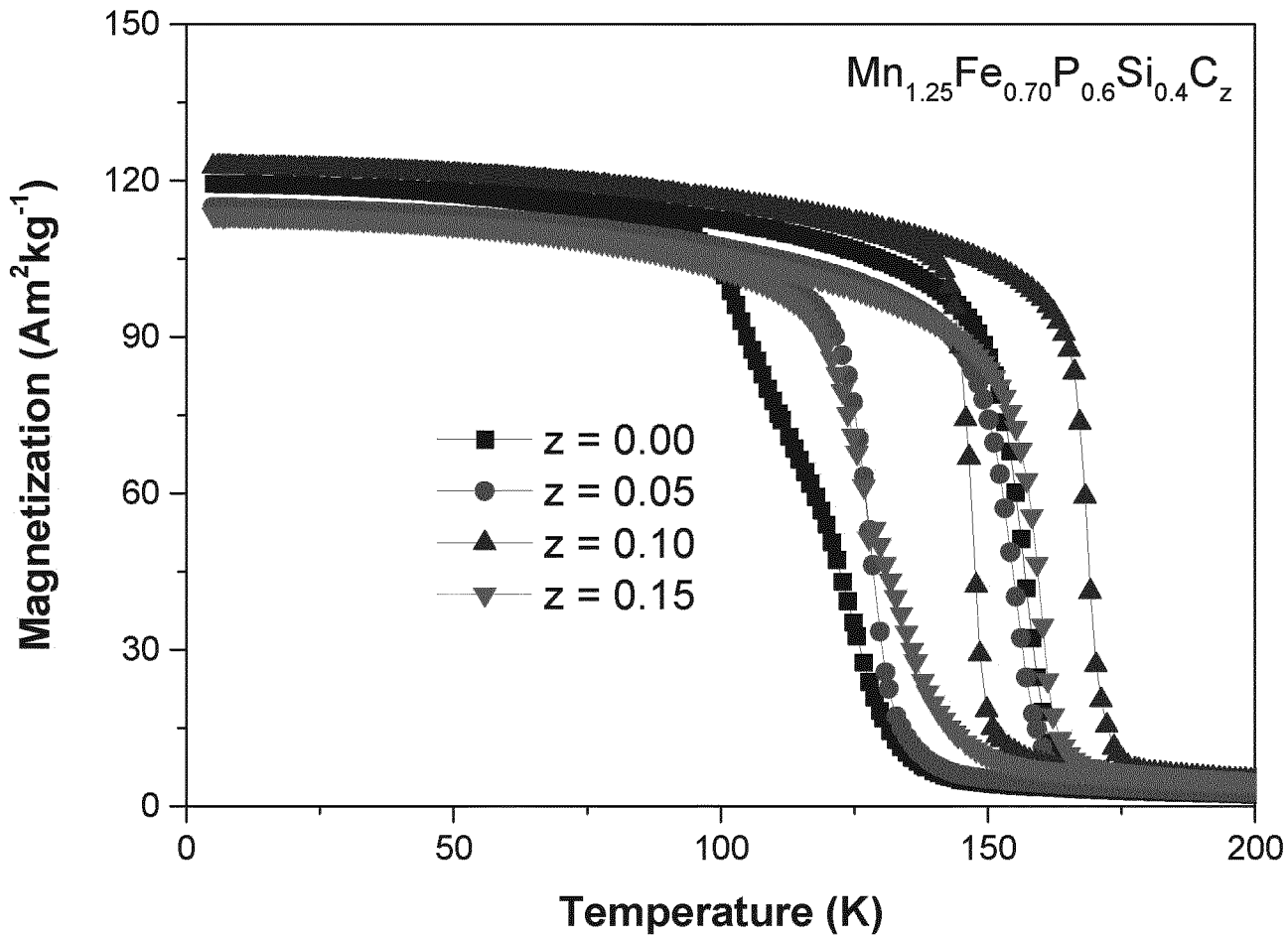
Figure 1C:
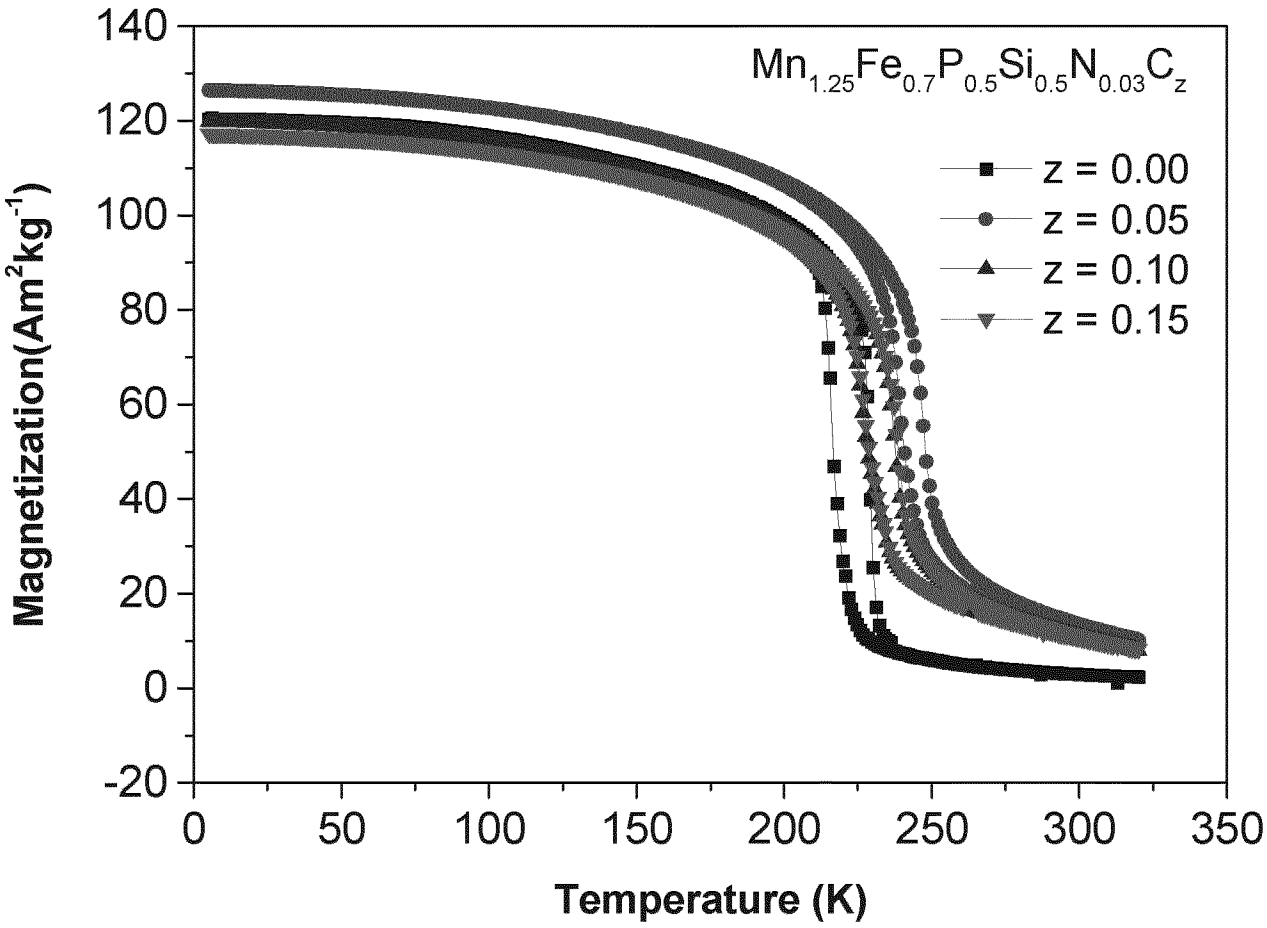
Figure 1D:
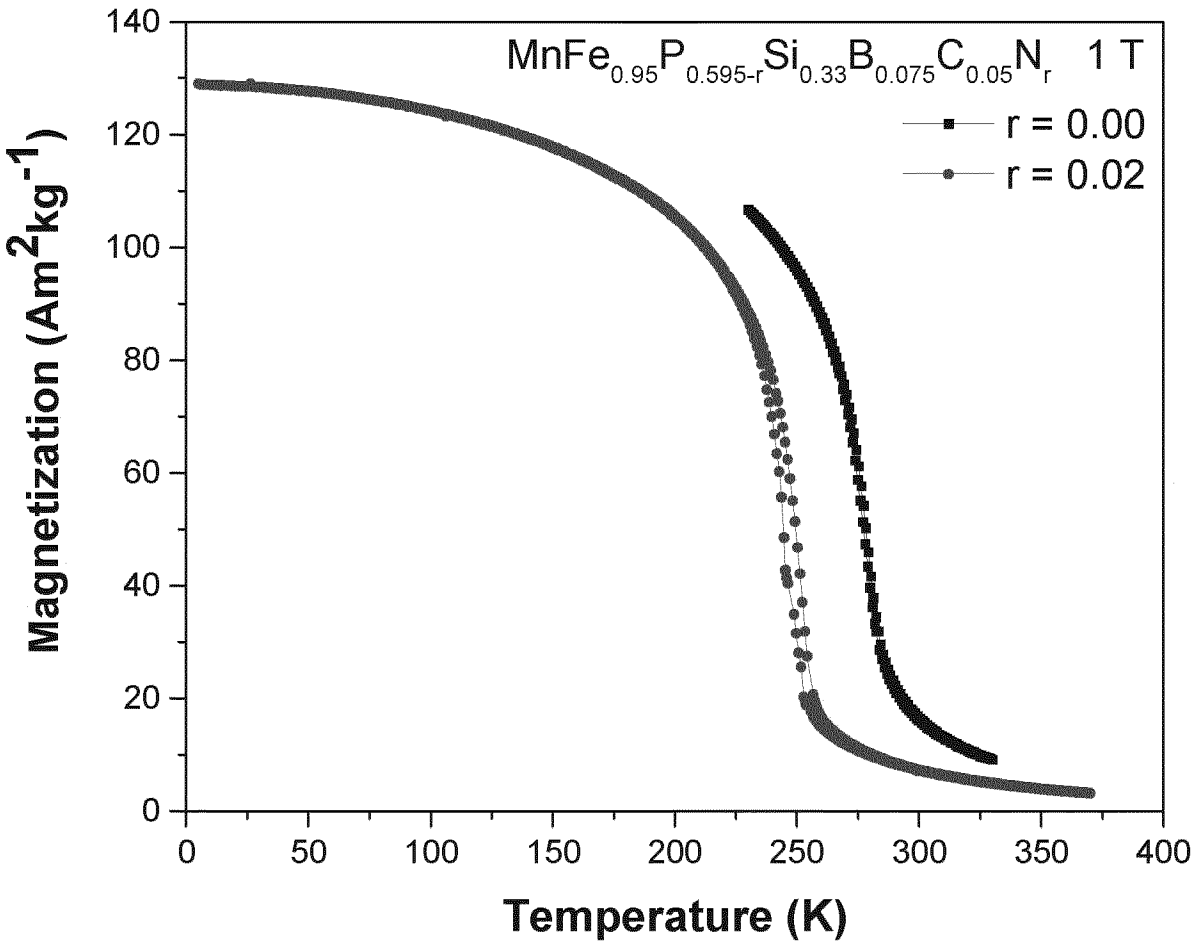

| | | | |
|---|---|---|---|
| WO | WO 2004/068512 | A1 | 8/2004 |
| WO | WO 2010/121977 | A1 | 10/2010 |
| WO | WO 2015/018610 | A1 | 2/2015 |
| WO | WO 2015/018678 | A1 | 2/2015 |
| WO | WO 2015/018705 | A1 | 2/2015 |
| WO | WO 2017/072334 | A1 | 5/2017 |

OTHER PUBLICATIONS

Extended European Search Report dated Dec. 22, 2016, in EP 16173919.8, filed Jun. 10, 2016.

Miao, X.F., et al., "Tuning the magnetoelastic transition in $(Mn,Fe)_2(P,Si)$ by B, C, and N doping", Scripta Materialia, vol. 124, XP 029698318, Jul. 20, 2016, pp. 129-132.

Combined Chinese Office Action and Search Report dated Mar. 4, 2020 in corresponding Chinese Patent Application No. 201780034245.8, 6 pages.

* cited by examiner

MAGNETOCALORIC MATERIALS COMPRISING MANGANESE, IRON, SILICON, PHOSPHORUS AND CARBON

The present invention relates to magnetocaloric materials comprising manganese, iron, phosphorus, silicon, carbon and optionally one or both of nitrogen and boron, to processes for producing said magnetocaloric materials, to the use of said magnetocaloric materials in a device selected from the group consisting of cooling systems, heat exchangers, heat pumps, thermomagnetic generators and thermomagnetic switches, and to corresponding devices comprising at least one magnetocaloric material according to the present invention.

Magnetocaloric materials are materials exhibiting a magnetocaloric effect, i.e. a temperature change caused by exposing said material to a changing external magnetic field. Application of an external magnetic field to a magnetocaloric material at an ambient temperature in the vicinity of the Curie temperature of said magnetocaloric material causes an alignment of the randomly aligned magnetic moments of the magnetocaloric material and thus a magnetic phase transition, which can also be described as an induced increase of the Curie temperature of the material above said ambient temperature. This magnetic phase transition implies a loss in magnetic entropy and under adiabatic conditions leads to an increase in the entropy contribution of the crystal lattice of the magnetocaloric material by phonon generation. As a result of applying the external magnetic field, therefore, a heating of the magnetocaloric material occurs.

In technical applications of the magnetocaloric effect, the generated heat is removed from the magnetocaloric material by heat transfer to a heat sink in the form of a heat transfer medium, e.g. water. Subsequent removing of the external magnetic field can be described as a decrease of the Curie temperature back below the ambient temperature, and thus allows the magnetic moments to revert to a random arrangement. This causes an increase of the magnetic entropy and a reduction of the entropy contribution of the crystal lattice of the magnetocaloric material itself, and under adiabatic conditions leads to a cooling of the magnetocaloric material below the ambient temperature. The described process cycle including magnetization and demagnetization is typically performed periodically in technical applications.

An important class of magnetocaloric materials are compounds which comprise manganese, iron, silicon and phosphorus. Such materials and a process for the preparation thereof are generally described in WO 2004/068512. US 2011/0167837 and US 2011/0220838 disclose magnetocaloric materials consisting of manganese, iron, silicon and phosphorus. WO 2015/018610, WO 2015/018705 and WO 2015/018678 disclose magnetocaloric materials consisting of manganese, iron, silicon, phosphorus and boron. Non-prepublished patent application EP 15192313.3-1556 discloses magnetocaloric materials consisting of manganese, iron, phosphorus, silicon, nitrogen and optionally boron.

Related art is also:

US 2016/017462 A1

EP 2 422 347 A0/WO 2010/121977 A1

EP 0 493 019 A2

MIAO ET AL: "Tuning the magnetoelastic transition in $(Mn,Fe)_2(P,Si)$ by B, C, and N doping", SCRIPTA MATERIALIA, vol. 124, 20 Jul. 2016 (2016 Jul. 20), pages 129-132, XP029698318.

Several magnetocaloric materials which comprise manganese, iron, silicon and phosphorus exhibit magnetocaloric properties which are suitable for practical applications like cooling systems, heat exchangers, heat pumps, thermomagnetic generators and thermomagnetic switches. However, there is a need for magnetocaloric materials exhibiting the magnetocaloric effect at lower magnetic field strength, thus allowing operating a magnetocaloric device at lower magnetic field strength without compromising its performance. Reduction of the magnetic field strength needed for the magnetocaloric effect in turn would allow reduction of the mass of permanent magnets needed to generate the magnetic field. This would be a significant advantage, because the economic competitiveness of magnetocaloric devices strongly depends on the costs for permanent magnets.

It is an object of the present invention to provide new magnetocaloric materials having advantageous properties which facilitate technical application of the magnetocaloric effect.

According to the present invention, there is provided a magnetocaloric material comprising manganese, and
iron, and
silicon, and
phosphorus, and
carbon.

Preferred magnetocaloric materials of the present invention consist of manganese, and
iron, and
silicon, and
phosphorus, and
carbon.

Other preferred magnetocaloric materials of the present invention further comprise one or both of nitrogen and boron.

Accordingly, specific preferred magnetocaloric materials of the present invention consist of manganese, and
iron, and
silicon, and
phosphorus, and
carbon, and
boron, and
nitrogen.

Particularly preferred magnetocaloric materials of the present invention consist of manganese, and
iron, and
silicon, and
phosphorus, and
carbon, and
nitrogen.

Other particularly preferred magnetocaloric materials of the present invention consist of manganese, and
iron, and
silicon, and
phosphorus, and
carbon, and
boron.

Surprisingly it has been found that magnetocaloric materials which comprise manganese, iron, silicon, phosphorus and carbon reach the same magnetization at a lower magnetic field strength, compared to magnetocaloric materials which comprise manganese, iron, silicon, phosphorus and no carbon.

Ferromagnetic materials can be divided into magnetically "soft" materials, which are readily magnetized but do not tend to stay magnetized, and magnetically "hard" materials, which exhibit opposite behavior. Magnetically "hard" materials have high coercivity, whereas magnetically "soft" materials have low coercivity. Obviously, due to the presence of the carbon atoms, the magnetic properties are changed toward a magnetically "softer" behavior. This is surprising, since conventionally carbon is used to increase the magnetic hardness of ferromagnetic materials, e.g. in the carburization of steel.

Furthermore, it has been found that it is possible to adjust important parameters of the magnetocaloric behavior like the Curie temperature Tc, the magnetic entropy change $\Delta S_m$ and the thermal hysteresis $\Delta T_{hys}$ by varying the amount of carbon (and optionally one or both of nitrogen and boron).

Typically a magnetocaloric material according to the present invention exhibits a hexagonal $Fe_2P$ structure with a crystal lattice having the space group P-62m. Corresponding structures are described by M. Bacmann et al. in Journal of Magnetism and Magnetic Materials 134 (1994) 59-67 for magnetocaloric materials of the composition $MnFeP_{1-y}As_y$.

A material exhibiting a hexagonal $Fe_2P$ structure with a crystal lattice having the space group P-62m is herein understood as a material comprising a main phase which occupies 90% or more of the volume of the material, wherein said main phase has a hexagonal $Fe_2P$-structure with a crystal lattice exhibiting the space group P-62m. The existence of the hexagonal $Fe_2P$-structure with a crystal lattice exhibiting the space group P-62m is confirmed by X-ray diffraction patterns.

Preferably, a magnetocaloric material according to the present invention exhibits a hexagonal crystalline structure of the $Fe_2P$ type with a crystal lattice having the space group P-62m wherein carbon atoms occupy interstitial sites of said crystal lattice. Typically the carbon atoms occupy exclusively interstitial sites of said crystal lattice with the space group P-62m, i.e. there are no carbon atoms on crystal sites of said crystal lattice.

If boron atoms are present in said preferred magnetocaloric materials the boron atoms occupy exclusively crystal sites of said crystal lattice with the space group P-62m, i.e. there are no boron atoms on interstitial sites of said crystal lattice. If nitrogen atoms are present in said preferred magnetocaloric materials, the nitrogen atoms occupy crystal sites and/or interstitial sites of said crystal lattice with the space group P-62m.

Certain specific magnetocaloric materials according to the present invention exhibit a hexagonal crystalline structure of the $Fe_2P$ type with a crystal lattice having the space group P-62m wherein the carbon atoms occupy interstitial sites selected from the group consisting of 6k and 6j sites.

If boron atoms are present in said specific magnetocaloric materials the boron atoms occupy 1b crystal sites of said crystal lattice. If nitrogen atoms are present in said specific magnetocaloric materials, the nitrogen atoms occupy interstitial sites selected from the group consisting of 6k and 6j sites of said crystal lattice and/or crystal sites selected from the group consisting of 1b and 2c sites of said crystal lattice.

Herein, the term "crystals sites" denotes positions of atoms in a given crystal structure (here $Fe_2P$) which are defined by the translational rules of the crystal lattice of said crystal structure which are occupied in the parent material $Fe_2P$, and the term "interstitial sites" denotes positions of atoms in a given crystal structure which are also defined by the translational rules of the crystal lattice of said crystal structure, which however are not occupied in the parent material $Fe_2P$.

Formally, certain preferred magnetocaloric materials of the present invention can be considered as being derived from a corresponding parent material which exhibits a hexagonal $Fe_2P$ structure with a crystal lattice having the space group P-62m. Said parent material consists of iron, manganese, phosphorus and silicon (i.e. contains neither carbon nor nitrogen nor boron). In said parent material consisting of iron, manganese, phosphorus and silicon, iron and manganese occupy crystal sites occupied by iron in $Fe_2P$, and phosphorus and silicon occupy crystal sites occupied by phosphorus in $Fe_2P$.

In said preferred magnetocaloric materials of the present invention, carbon atoms occupy exclusively interstitial sites, i.e. they are present in addition to the phosphorus atoms and silicon atoms of the corresponding parent material. There are no carbon atoms on crystal sites of said crystal lattice. The number of iron atoms and manganese atoms of the corresponding parent material remains unchanged.

If boron atoms are present in said preferred magnetocaloric materials of the present invention they occupy exclusively crystal sites thereby replacing phosphorus atoms or silicon atoms of the corresponding parent material which consists of iron, manganese, phosphorus and silicon. If nitrogen atoms are present in said preferred magnetocaloric materials of the present invention, those nitrogen atoms which occupy crystal sites replace phosphorus atoms or silicon atoms of the corresponding parent material, and those nitrogen atoms which occupy interstitial sites are present in addition to the phosphorus atoms and silicon atoms of the corresponding parent material.

In a first group of preferred magnetocaloric materials according to the present invention, carbon atoms occupy interstitial sites of said crystal lattice with the space group P-62m. Preferably, in said first group of magnetocaloric materials according to the present invention, carbon atoms occupy interstitial sites selected from the group consisting of 6k and 6j sites of said crystal lattice. Preferably, a magnetocaloric material of said first group of preferred magnetocaloric materials according to the present invention consists of manganese, iron, silicon, phosphorus and carbon.

In a second group of preferred magnetocaloric materials according to the present invention, carbon atoms occupy interstitial sites of said crystal lattice with the space group P-62m, and boron atoms occupy crystal sites of said crystal lattice with the space group P-62m. Preferably, in said second group of preferred magnetocaloric materials according to the present invention, carbon atoms occupy interstitial sites selected from the group consisting of 6k and 6j sites of said crystal lattice, and/or boron atoms occupy 1b crystal sites of said crystal lattice. Preferably, a magnetocaloric material of said second group of preferred magnetocaloric materials according to the present invention consists of manganese, iron, phosphorus, silicon, carbon and boron.

In a third group of preferred magnetocaloric materials according to the present invention, carbon atoms occupy interstitial sites of said crystal lattice with the space group P-62m, and nitrogen atoms occupy crystal sites of said crystal lattice with the space group P-62m. Preferably, in said third group of preferred magnetocaloric materials according to the present invention, carbon atoms occupy interstitial sites selected from the group consisting of 6k and 6j sites of said crystal lattice, and/or nitrogen atoms occupy crystal sites selected from the group consisting of 1b and 2c sites of said crystal lattice. Preferably, a magnetocaloric material of said third group of preferred magnetocaloric materials according to the present invention consists of manganese, iron, phosphorus, silicon, carbon and nitrogen.

In a fourth group of preferred magnetocaloric materials according to the present invention, carbon atoms occupy interstitial sites of said crystal lattice with the space group P-62m, and nitrogen atoms occupy interstitial sites of said crystal lattice with the space group P-62m. Preferably, in said fourth group of preferred magnetocaloric materials according to the present invention, carbon atoms occupy interstitial sites selected from the group consisting of 6k and 6j sites of said crystal lattice, and/or nitrogen atoms occupy interstitial sites selected from the group consisting of 6k and 6j sites of said crystal lattice. Preferably, a magnetocaloric material of said fourth group of preferred magnetocaloric materials according to the present invention consists of manganese, iron, phosphorus, silicon, carbon and nitrogen.

In a fifth group of preferred magnetocaloric materials according to the present invention, carbon atoms occupy interstitial sites of said crystal lattice with the space group P-62m, and nitrogen atoms occupy interstitial sites and crystal sites of said crystal lattice with the space group P-62m. Preferably, in said fifth group of preferred magnetocaloric materials according to the present invention, carbon atoms occupy interstitial sites selected from the group consisting of 6k and 6j sites of said crystal lattice, and/or nitrogen atoms occupy interstitial sites selected from the group consisting of 6k and 6j sites of said crystal lattice and/or crystal sites selected from the group consisting of 1b and 2c sites of said crystal lattice. Preferably, a magnetocaloric material of said fifth group of preferred magnetocaloric materials according to the present invention consists of manganese, iron, phosphorus, silicon, carbon and nitrogen.

In a sixth group of preferred magnetocaloric materials according to the present invention, carbon atoms occupy interstitial sites of said crystal lattice with the space group P-62m, boron atoms occupy crystal sites of said crystal lattice with the space group P-62m, and nitrogen atoms occupy crystal sites of said crystal lattice with the space group P-62m. Preferably, in said sixth group of preferred magnetocaloric materials according to the present invention, carbon atoms occupy interstitial sites selected from the group consisting of 6k and 6j sites of said crystal lattice and/or boron atoms occupy 1b crystal sites of said crystal lattice and/or nitrogen atoms occupy crystal sites selected from the group consisting of 1b and 2c sites of said crystal lattice. Preferably, a magnetocaloric material of said sixth group of preferred magnetocaloric materials according to the present invention consists of manganese, iron, phosphorus, silicon, carbon, boron and nitrogen.

In a seventh group of preferred magnetocaloric materials according to the present invention, carbon atoms occupy interstitial sites of said crystal lattice with the space group P-62m, boron atoms occupy crystal sites of said crystal lattice with the space group P-62m, and nitrogen atoms occupy interstitial sites of said crystal lattice with the space group P-62m. Preferably, in said seventh group of preferred magnetocaloric materials according to the present invention, carbon atoms occupy interstitial sites selected from the group consisting of 6k and 6j sites of said crystal lattice, and/or boron atoms occupy 1b crystal sites of said crystal lattice, and/or nitrogen atoms occupy interstitial sites selected from the group consisting of 6k and 6j sites of said crystal lattice. Preferably, a magnetocaloric material of said seventh group of preferred magnetocaloric materials according to the present invention consists of manganese, iron, phosphorus, silicon, carbon, boron and nitrogen.

In an eighth group of preferred magnetocaloric materials according to the present invention, carbon atoms occupy interstitial sites of said crystal lattice with the space group P-62m, boron atoms occupy crystal sites of said crystal lattice with the space group P-62m and nitrogen atoms occupy interstitial sites and crystal sites of said crystal lattice with the space group P-62m. Preferably, in said eighth group of preferred magnetocaloric materials according to the present invention, carbon atoms occupy interstitial sites selected from the group consisting of 6k and 6j sites of said crystal lattice, and/or boron atoms occupy 1b crystal sites of said crystal lattice, and/or nitrogen atoms occupy interstitial sites selected from the group consisting of 6k and 6j sites of said crystal lattice and/or crystal sites selected from the group consisting of 1b and 2c sites of said crystal lattice. Preferably, a magnetocaloric material of said eighth group of preferred magnetocaloric materials according to the present invention consists of manganese, iron, phosphorus, silicon, carbon, boron and nitrogen.

Preferred magnetocaloric materials according to the present invention consist of manganese, iron, phosphorus, silicon, carbon and optionally one or both of boron and nitrogen and have a composition according to the general formula (I)

$$(Mn_xFe_{1-x})_{2+u}P_ySi_vC_zN_rB_w \quad (I)$$

wherein $-0.1 \le u \le 0.1$, preferably $-0.05 \le u \le 0.05$ $0.2 \le x \le 0.8$, preferably $0.3 \le x \le 0.7$, more preferably $0.35 \le x \le 0.65$ $0.3 \le y \le 0.75$, preferably $0.4 \le y \le 0.7$ $0.25 \le v \le 0.7$, preferably $0.3 \le v \le 0.6$ $0.001 \le z \le 0.15$, preferably $0.003 \le z \le 0.12$, more preferably $0.005 \le z \le 0.1$ $0 \le r \le 0.1$, preferably $0 \le r \le 0.07$, more preferably $0\ r \le 0.04$ $0 \le w \le 0.1$, preferably $0 \le w \le 0.08$ $y+v+w \le 1.05$, preferably $\le 1.02$, preferably $\le 1$ $y+v+w+r \ge 0.95$, preferably 0.98, preferably 1.

Herein it is understood that in a given material according to formula (I)

$$y+v+w \le y+v+w+r.$$

In formulae (I) to (XI), the subscripts x, y, v, z, w and r denote the atomic fraction of the corresponding element (Mn, Fe, P, Si, C, B and N).

A magnetocaloric material according to formula (I) exhibits a hexagonal crystalline structure of the $Fe_2P$ type with a crystal lattice having the space group P-62m.

If neither boron nor nitrogen is present (w=r=0), then y+v is in the range of from 0.95 to 1.05, preferably in the range of from 0.98 to 1.02, most preferably y+v=1. Those preferred magnetocaloric materials according to formula (I) belong to the above-defined first group of preferred magnetocaloric materials according to the present invention.

If no nitrogen is present (r=0) and boron is present (w>0), the boron atoms occupy exclusively crystal sites, then y+v+w is in the range of from 0.95 to 1.05, preferably y+v+w is in the range of from 0.98 to 1.02, most preferably y+v+w=1. Those preferred magnetocaloric materials according to formula (I) belong to the above-defined second group of preferred magnetocaloric materials according to the present invention.

If no boron is present (w=0) and nitrogen is present (r>0) and the nitrogen atoms occupy only crystal sites (i.e. no nitrogen atoms are on interstitial sites), then y+v+r is in the range of from 0.95 to 1.05, preferably in the range of from 0.98 to 1.02, most preferably y+v+r=1. Those preferred magnetocaloric materials according to formula (I) belong to the above-defined third group of preferred magnetocaloric materials according to the present invention.

If no boron is present (w=0) and nitrogen is present (r>0) and the nitrogen atoms occupy only interstitial sites (i.e. no nitrogen atoms are on crystal sites), then y+v is in the range of from 0.95 to 1.05, preferably in the range of from 0.98 to 1.02, most preferably y+v=1. Those preferred magnetocaloric materials according to formula (I) belong to the above-defined fourth group of preferred magnetocaloric materials according to the present invention.

If no boron is present (w=0) and nitrogen is present (r>0) and the nitrogen atoms occupy crystal sites and interstitial sites, then y+v is <1.05, preferably <1.02, most preferably <1 and y+v+r>0.95, preferably >0.98, most preferably >1. Those preferred magnetocaloric materials according to formula (I) belong to the above-defined fifth group of preferred magnetocaloric materials according to the present invention.

If boron is present (w>0) and nitrogen is present (r>0) and the nitrogen atoms occupy only crystal sites (i.e. no nitrogen atoms are on interstitial sites), then y+v+w+r is in the range of from 0.95 to 1.05, preferably in the range of from 0.98 to 1.02, most preferably y+v+w+r=1. Those preferred magnetocaloric materials according to formula (I) belong to the above-defined sixth group of preferred magnetocaloric materials according to the present invention.

If boron is present (w>0) and nitrogen is present (r>0) and the nitrogen atoms occupy only interstitial sites (i.e. no nitrogen atoms are on crystal sites), then y+v+w is in the range of from 0.95 to 1.05, preferably in the range of from 0.98 to 1.02, most preferably y+v+w=1. Those preferred magnetocaloric materials according to formula (I) belong to the above-defined seventh group of preferred magnetocaloric materials according to the present invention.

If boron is present (w>0) and nitrogen is present (r>0) and the nitrogen atoms occupy crystal sites and interstitial sites, then y+v+w is <1.05, preferably <1.02, most preferably <1 and y+v+r>0.95, preferably >0.98, most preferably >1. Those preferred magnetocaloric materials according to formula (I) belong to the above-defined eighth group of preferred magnetocaloric materials according to the present invention.

Certain preferred magnetocaloric materials according to formula (I) consist of manganese, iron, silicon, phosphorus and carbon and have a composition according to the general formula (II)

$$(Mn_xFe_{1-x})_{2+u}P_ySi_vC_z \quad (II)$$

wherein $-0.1 \le u \le 0.1$, preferably $-0.05 \le u \le 0.05$ $0.2 \le x \le 0.8$, preferably $0.3 \le x \le 0.7$, more preferably $0.35 \le x \le 0.65$ $0.3 \le y \le 0.75$, preferably $0.4 \le y \le 0.7$ $0.25 \le v \le 0.7$, preferably $0.3 \le v \le 0.6$ $0.001 \le z \le 0.15$, preferably $0.003 \le z \le 0.12$, more preferably $0.005 \le z \le 0.1$ $0.95 \le y+v \le 1.05$, preferably $0.98 \le y+v \le 1.02$, more preferably y+v=1.

In magnetocaloric materials according to formula (II), the carbon atoms occupy interstitial sites of said crystal lattice with the space group P-62m. Preferably, in said magnetocaloric materials according to formula (II), the carbon atoms occupy interstitial sites selected from the group consisting of 6k and 6j sites of said crystal lattice. Magnetocaloric materials according to formula (II) belong to the above-defined first group of preferred magnetocaloric materials according to the present invention.

Certain other preferred magnetocaloric materials according to formula (I) consist of manganese, iron, phosphorus, silicon, carbon and boron and have a composition according to the general formula (III)

$$(Mn_xFe_{1-x})_{2+u}P_ySi_vC_zB_w \quad (III)$$

wherein $-0.1 \le u \le 0.1$, preferably $-0.05 \le u \le 0.05$ $0.2 \le x \le 0.8$, preferably $0.3 \le x \le 0.7$, more preferably $0.35 \le x \le 0.65$ $0.3 \le y \le 0.75$, preferably $0.4 \le y \le 0.7$ $0.25 \le v \le 0.7$, preferably $0.3 \le v$ 5-0.6

$0.001 \le z \le 0.15$, preferably $0.003 \le z \le 0.12$, more preferably $0.005 \le z \le 0.1$ $0 < w \le 0.1$, preferably $0.01 \le \le w \le 0.08$ $0.95 \le y+v+w \le 1.05$, preferably $0.98 \le y+v+w \le 1.02$, more preferably y+v+w=1.

In magnetocaloric materials according to formula (III), the carbon atoms occupy interstitial sites of said crystal lattice with the space group P-62m, and the boron atoms occupy crystal sites of said crystal lattice with the space group P-62m. Preferably, in said magnetocaloric materials according to formula (III), the carbon atoms occupy interstitial sites selected from the group consisting of 6k and 6j sites of said crystal lattice, and the boron atoms occupy 1b crystal sites of said crystal lattice. Magnetocaloric materials according to formula (III) belong to the above-defined second group of preferred magnetocaloric materials according to the present invention.

Certain other preferred magnetocaloric materials according to formula (I) consist of manganese, iron, phosphorus, silicon, carbon and nitrogen and have a composition according to the general formula (IV)

$$(Mn_xFe_{1-x})_{2+u}P_ySi_vC_zN_r \quad (IV)$$

wherein $-0.1 \le u \le 0.1$, preferably $-0.05 \le u \le 0.05$ $0.2 \le x \le 0.8$, preferably $0.3 \le x \le 0.7$, more preferably $0.35 \le x \le 0.65$ $0.3 \le y \le 0.75$, preferably $0.4 \le y \le 0.7$ $0.25 \le v \le 0.7$, preferably $0.3 \le v \le 0.6$ $0.001 \le z \le 0.15$, preferably $0.003 \le z \le 0.12$, more preferably $0.005 \le z \le 0.1$ $0 < r \le 0.1$, preferably $0.005 \le r \le 0.07$, more preferably $0.01 \le r \le 0.04$ $y+v \le 1.05$, preferably $\le 1.02$, preferably $\le 1$ $y+v+r \ge 0.95$, preferably $\ge 0.98$, preferably $\ge 1$.

Herein it is understood that in a given material according to formula (IV)

$$y+v<y+v+r.$$

In magnetocaloric materials according to formula (IV), the carbon atoms occupy interstitial sites of said crystal lattice with the space group P-62m and the nitrogen atoms occupy crystal sites and/or interstitial sites of said crystal lattice with the space group P-62m. Preferably, the carbon atoms occupy interstitial sites selected from the group consisting of 6k and 6j sites of said crystal lattice, and the nitrogen atoms occupy interstitial sites selected from the group consisting of 6k and 6j sites of said crystal lattice and/or crystal sites selected from the group consisting of 1b and 2c sites of said crystal lattice. Magnetocaloric materials according to formula (IV) belong to one of the above-defined third, fourth and fifth group of preferred magnetocaloric materials according to the present invention.

Certain preferred magnetocaloric materials according to formula (IV) consist of manganese, iron, phosphorus, silicon, carbon and nitrogen and have a composition according to the general formula (IV)

$$(Mn_xFe_{1-x})_{2+u}P_ySi_vC_zN_r \quad (V)$$

wherein $-0.1 \leq u \leq 0.1$, preferably $-0.05 \leq u \leq 0.05$ $0.2 \leq x \leq 0.8$, preferably $0.3 \leq x \leq 0.7$, more preferably $0.35 \leq x \leq 0.65$ $0.3 \leq y \leq 0.75$, preferably $0.4 \leq y \leq 0.7$ $0.25 \leq V \leq 0.7$, preferably $0.3 \leq v \leq 0.6$ $0.001 \leq z \leq 0.15$, preferably $0.003 \leq z \leq 0.12$, more preferably $0.005 \leq z \leq 0.1$ $0 < r \leq 0.1$, preferably $0.005 \leq r \leq 0.07$, more preferably $0.01 \leq r \leq 0.04$ $0.95 \leq y+v+r \leq 1.05$, preferably $0.98 \leq y+v+r \leq 1.02$, more preferably $y+v+r=1$.

In magnetocaloric materials according to formula (V), the carbon atoms occupy interstitial sites of said crystal lattice with the space group P-62m and the nitrogen atoms occupy crystal sites of said crystal lattice with the space group P-62m. Preferably, the carbon atoms occupy interstitial sites selected from the group consisting of 6k and 6j sites of said crystal lattice, and the nitrogen atoms occupy crystal sites selected from the group consisting of 1b and 2c sites of said crystal lattice. Magnetocaloric materials according to formula (V) belong to the above-defined third group of preferred magnetocaloric materials according to the present invention.

Certain preferred magnetocaloric materials according to formula (IV) consist of manganese, iron, phosphorus, silicon, carbon and nitrogen and have a composition according to the general formula (VI)

$$(Mn_xFe_{1-x})_{2+u}P_ySi_vC_zN_r \quad \text{(VI)}$$

wherein $-0.1 \leq u \leq 0.1$, preferably $-0.05 \leq u \leq 0.05$ $0.2 \leq x \leq 0.8$, preferably $0.3 \leq x \leq 0.7$, more preferably $0.35 \leq x \leq 0.65$ $0.3 \leq y \leq 0.75$, preferably $0.4 \leq y \leq 0.7$ $0.25 \leq v \leq 0.7$, preferably $0.3 \leq v \leq 0.6$ $0.001 \leq z \leq 0.15$, preferably $0.003 \leq z \leq 0.12$, more preferably $0.005 \leq z \leq 0.1$ $0 < r \leq 0.1$, preferably $0.005 \leq r \leq 0.07$, more preferably $0.01 \leq r \leq 0.04$ $0.95 \leq y+v \leq 1.05$, preferably $0.98 \leq y+v \leq 1.02$, more preferably $y+v=1$.

In magnetocaloric materials according to formula (VI), the carbon atoms and the nitrogen atoms occupy interstitial sites of said crystal lattice with the space group P-62m. Preferably, the carbon atoms occupy interstitial sites selected from the group consisting of 6k and 6j sites of said crystal lattice, and the nitrogen atoms occupy interstitial sites selected from the group consisting of 6k and 6j sites of said crystal lattice. Magnetocaloric materials according to formula (VI) belong to the above-defined fourth group of preferred magnetocaloric materials according to the present invention.

Certain other preferred magnetocaloric materials according to formula (IV) consist of manganese, iron, phosphorus, silicon, carbon and nitrogen and have a composition according to the general formula (VII)

$$(Mn_xFe_{1-x})_{2+u}P_ySi_vC_z N_r \quad \text{(VII)}$$

wherein $-0.1 \leq u \leq 0.1$, preferably $-0.05 \leq u \leq 0.05$ $0.2 \leq x \leq 0.8$, preferably $0.3 \leq x \leq 0.7$, more preferably $0.35 \leq x \leq 0.65$ $0.3 \leq y \leq 0.75$, preferably $0.4 \leq y \leq 0.7$ $0.25 \leq v \leq 0.7$, preferably $0.3 \leq v \leq 0.6$ $0.001 \leq z \leq 0.15$, preferably $0.003 \leq z \leq 0.12$, more preferably $0.005 \leq z \leq 0.1$ $0 < r \leq 0.1$, preferably $0.005 \leq r \leq 0.07$, more preferably $0.01 \leq r \leq 0.04$ $y+v \leq 1.05$, preferably $<1.02$, preferably $<1$ $y+v+r > 0.95$, preferably $>0.98$, preferably $>1$.

Herein it is understood that in a given material according to formula (VII) $y+v<y+v+r$.

In magnetocaloric materials according to formula (VII), the carbon atoms occupy interstitial sites of said crystal lattice with the space group P-62m and the nitrogen atoms occupy crystal sites and interstitial sites of said crystal lattice with the space group P-62m. Preferably, the carbon atoms occupy interstitial sites selected from the group consisting of 6k and 6j sites of said crystal lattice, and the nitrogen atoms occupy interstitial sites selected from the group consisting of 6k and 6j sites of said crystal lattice and crystal sites selected from the group consisting of 1b and 2c sites of said crystal lattice. Magnetocaloric materials according to formula (VII) belong to the above-defined fifth group of preferred magnetocaloric materials according to the present invention.

Certain other preferred magnetocaloric materials according to formula (I) consist of manganese, iron, phosphorus, silicon, carbon, nitrogen and boron, and have a composition according to the general formula (VIII)

$$(Mn_xFe_{1-x})_{2+u}P_ySi_vC_zN_rB_w \quad \text{(VIII)}$$

wherein $-0.1 \leq u \leq 0.1$, preferably $-0.05 \leq u \leq 0.05$ $0.2 \leq x \leq 0.8$, preferably $0.3 \leq x \leq 0.7$, more preferably $0.35 \leq x \leq 0.65$ $0.3 \leq y \leq 0.75$, preferably $0.4 \leq y \leq 0.7$ $0.25 \leq v \leq 0.7$, preferably $0.3 \leq v \leq 0.6$ $0.001 \leq z \leq 0.15$, preferably $0.003 \leq z \leq 0.12$, more preferably $0.005 \leq z \leq 0.1$ $0 \leq r \leq 0.1$, preferably $0.005 \leq r \leq 0.07$, more preferably $0.01 \leq r \leq 0.04$ $0 < w \leq 0.1$, preferably $0.01 \leq \leq w \leq 0.08$ $y+v+w \leq 1.05$, preferably $\leq 1.02$, preferably $\leq 1$ $y+v+w+r \leq 0.95$, preferably 0.98, preferably 1.

Herein it is understood that in a given material according to formula (VIII)

$$y+v+w<y+v+w+r.$$

In magnetocaloric materials according to formula (VIII), the carbon atoms occupy interstitial sites of said crystal lattice with the space group P-62m, the nitrogen atoms occupy crystal sites and/or interstitial sites of said crystal lattice with the space group P-62m, and the boron atoms occupy crystal sites of said crystal lattice with the space group P-62m Preferably, the carbon atoms occupy interstitial sites selected from the group consisting of 6k and 6j sites of said crystal lattice, the nitrogen atoms occupy interstitial sites selected from the group consisting of 6k and 6j sites of said crystal lattice and/or crystal sites selected from the group consisting of 1b and 2c sites of said crystal lattice, and the boron atoms occupy 1b crystal sites of said crystal lattice. Magnetocaloric materials according to formula (VIII) belong to one of the above-defined sixth, seventh and eighth group of preferred magnetocaloric materials according to the present invention.

Certain preferred magnetocaloric materials according to formula (VIII) consist of manganese, iron, phosphorus, silicon, carbon, nitrogen and boron, and have a composition according to the general formula (IX)

$$(Mn_xFe_{1-x})_{2+u}P_ySi_vC_zN_rB_w \quad \text{(IX)}$$

wherein $-0.1 \leq u \leq 0.1$, preferably $-0.05 \leq u \leq 0.05$ $0.2 \leq x \leq 0.8$, preferably $0.3 \leq x \leq 0.7$, more preferably $0.35 \leq x \leq 0.65$ $0.3 \leq y \leq 0.75$, preferably $0.4 \leq y \leq 0.7$ $0.25 \leq V \leq 0.7$, preferably $0.3 \leq v \leq 0.6$ $0.001 \leq z \leq 0.15$, preferably $0.003 \leq z \leq 0.12$, more preferably $0.005 \leq z \leq 0.1$ $0 < r \leq 0.1$, preferably $0.005 \leq r \leq 0.07$, more preferably $0.01 \leq r \leq 0.04$ $0 < w \leq 0.1$, preferably $0.01 \leq W \leq 0.08$ $0.95 \leq y+v+r+w \leq 1.05$, preferably $0.98 \leq y+v+r+w \leq 1.02$, more preferably $y+v+r+w=1$.

In magnetocaloric materials according to formula (IX), the carbon atoms occupy interstitial sites of said crystal lattice with the space group P-62m, and the nitrogen atoms and the boron atoms occupy crystal sites of said crystal lattice with the space group P-62m. Preferably, the carbon atoms occupy interstitial sites selected from the group consisting of 6k and 6j sites of said crystal lattice, the nitrogen atoms occupy crystal sites selected from the group consisting of 1b and 2c sites of said crystal lattice, and the boron atoms occupy 1b crystal sites of said crystal lattice. Magnetocaloric materials according to formula (IX) belong to the above-defined sixth group of preferred magnetocaloric materials according to the present invention.

Certain other preferred magnetocaloric materials according to formula (VIII) consist of manganese, iron, phosphorus, silicon, carbon, nitrogen and boron, and have a composition according to the general formula (X)

$$(Mn_xFe_{1-x})_{2+u}P_ySi_vC_zN_rB_w \quad (X)$$

wherein $-0.1 \leq u \leq 0.1$, preferably $-0.05 \leq u \leq 0.05$ $0.2 \leq x \leq 0.8$, preferably $0.3 \leq x \leq 0.7$, more preferably $0.35 \leq x \leq 0.65$ $0.3 \leq y \leq 0.75$, preferably $0.4 \leq y \leq 0.7$ $0.25 \leq v \leq 0.7$, preferably $0.3 \leq v \leq 0.6$ $0.001 \leq z \leq 0.15$, preferably $0.003\ z \leq 0.12$, more preferably $0.005 \leq z \leq 0.1$ $0 < r \leq 0.1$, preferably $0.005 \leq r \leq 0.07$, more preferably $0.01 \leq r \leq 0.04$ $0 < w \leq 0.1$, preferably $0.01 \leq w \leq 0.08$ $0.95 \leq y+v+w \leq 1.05$, preferably $0.98 \leq y+v+w \leq 1.02$, more preferably $y+v+w=1$.

In magnetocaloric materials according to formula (X), the carbon atoms and the nitrogen atoms occupy interstitial sites of said crystal lattice with the space group P-62m, and the boron atoms occupy crystal sites of said crystal lattice with the space group P-62m. Preferably, the carbon atoms occupy interstitial sites selected from the group consisting of 6k and 6j sites of said crystal lattice, the nitrogen atoms occupy interstitial sites selected from the group consisting of 6k and 6j sites of said crystal lattice, and the boron atoms occupy 1b crystal sites of said crystal lattice. Magnetocaloric materials according to formula (X) belong to the above-defined seventh group of preferred magnetocaloric materials according to the present invention.

Certain other preferred magnetocaloric materials according to formula (VIII) consist of manganese, iron, phosphorus, silicon, carbon, nitrogen and boron, and have a composition according to the general formula (XI)

$$(Mn_xFe_{1-x})_{2+u}P_ySi_vC_zN_rB_w \quad (XI)$$

wherein $-0.1 \leq u \leq 0.1$, preferably $-0.05 \leq u \leq 0.05$ $0.2 \leq x \leq 0.8$, preferably $0.3 \leq x \leq 0.7$, more preferably $0.35 \leq x \leq 0.65$ $0.3 \leq y \leq 0.75$, preferably $0.4 \leq y \leq 0.7$ $0.25 \leq v \leq 0.7$, preferably $0.3 \leq V \leq 0.6$ $0.001 \leq Z \leq 0.15$, preferably $0.003 \leq z \leq 0.12$, more preferably $0.005 \leq z \leq 0.1$ $0 < r \leq 0.1$, preferably $0.005 \leq r \leq 0.07$, more preferably $0.01\ r \leq 0.04$ $0 < w \leq 0.1$, preferably $0.01 \leq W \leq 0.08$ $y+v+w < 1.05$, preferably $<1.02$, preferably $<1$ $y+v+w+r > 0.95$, preferably $>0.98$, preferably $>1$.

Herein it is understood that in a given material according to formula (XI)

$$y+v+w < y+v+w+r.$$

In magnetocaloric materials according to formula (XI), the carbon atoms occupy interstitial sites of said crystal lattice with the space group P-62m, the nitrogen atoms occupy crystal sites and interstitial sites of said crystal lattice with the space group P-62m, and the boron atoms occupy crystal sites of said crystal lattice with the space group P-62m. Preferably, the carbon atoms occupy interstitial sites selected from the group consisting of 6k and 6j sites of said crystal lattice, and the nitrogen atoms occupy interstitial sites selected from the group consisting of 6k and 6j sites of said crystal lattice and crystal sites selected from the group consisting of 1b and 2c sites of said crystal lattice, and the boron atoms occupy 1b crystal sites of said crystal lattice. Magnetocaloric materials according to formula (XI) belong to the above-defined eighth group of preferred magnetocaloric materials according to the present invention.

Specifically preferred magnetocaloric materials of the present invention are those selected from the group consisting of $Mn_{1.25}Fe_{0.7}P_{0.5}Si_{0.5}C_{0.05}$, $Mn_{1.25}Fe_{0.7}P_{0.5}Si_{0.5}C_{0.1}$, $Mn_{1.25}Fe_{0.7}P_{0.5}Si_{0.5}C_{0.15}$, $Mn_{1.25}Fe_{0.7}P_{0.5}Si_{0.5}N_{0.03}C_{0.05}$, $Mn_{1.25}Fe_{0.7}P_{0.5}Si_{0.5}N_{0.03}C_{0.1}$, $Mn_{1.25}Fe_{0.7}P_{0.5}Si_{0.5}N_{0.03}C_{0.15}$ $Mn_{1.25}Fe_{0.7}P_{0.6}Si_{0.4}C_{0.05}$, $Mn_{1.25}Fe_{0.7}P_{0.6}Si_{0.4}C_{0.1}$, $Mn_{1.25}Fe_{0.7}P_{0.6}Si_{0.4}C_{0.15}$ $MnFe_{0.95}P_{0.67}Si_{0.33}C_{0.01}$, $MnFe_{0.95}P_{0.67}Si_{0.33}C_{0.02}$, $MnFe_{0.95}P_{0.67}Si_{0.33}C_{0.03}$, $MnFe_{0.95}P_{0.67}Si_{0.33}C_{0.05}$, $MnFe_{0.95}P_{0.67}Si_{0.33}C_{0.1}$, $MnFe_{0.95}P_{0.575}Si_{0.33}B_{0.075}O_{0.05}N_{0.02}$, $Mn_{1.18}Fe_{0.73}P_{0.48}Si_{0.52}C_{0.012}$, $Mn_{1.19}Fe_{0.73}P_{0.48}Si_{0.52}C_{0.032}$, $Mn_{1.16}Fe_{0.75}P_{0.47}Si_{0.53}C_{0.06}$ Preferred magnetocaloric materials according to the present invention exhibit

- a Curie temperature Tc in the range of from 150 K to 500 K, preferably in the range of from 200 K to 450 K, further preferably in the range of from 240 K to 350 K, and/or

- a magnetic entropy change $\Delta S_m$ of more than 3 J $kg^{-1}$ $K^{-1}$ or more, preferably of more than 4 J $kg^{-1}$ $K^1$ or more, more preferably of 5 J $kg^{-1}$ $K^1$ or more, in each case at a magnetic field change of 1 Tesla and/or

- a thermal hysteresis $\Delta T_{hys}$ of 10 K or less, preferably of 5 K or less, more preferably of 3 K or less, in each case at zero magnetic field at a sweep rate of 2 K/min and/or

- a volume change of the elementary cell during the magnetic phase transition of 0.2% or less, preferably of 0.1% or less.

Preferred magnetocaloric materials according to the present invention are those which exhibit two or more of the above-defined preferred features in combination. Specifically preferred magnetocaloric materials according to the present invention exhibit a Curie temperature Tc in the range of from 150 K to 500 K, preferably in the range of from 200 K to 450 K, further preferably in the range of from 240 K to 350 K and/or magnetic entropy change $\Delta S_m$ of more than 3 J $kg^{-1}$ $K^{-1}$ or more, preferably of more than 4 J $kg^{-1}$ $K^{-1}$ or more, more preferably of 5 J $kg^{-1}$ $K^{-1}$ or more, in each case at a magnetic field change of 1 Tesla and/or a thermal hysteresis $\Delta T_{hys}$ of 10 K or less, preferably of 5 K or less, more preferably of 3 K or less, in each case at zero magnetic field at a sweep rate of 2 K/min and/or a volume change of the elementary cell during the magnetic phase transition of 0.2 or less, preferably of 0.1% or less.

The Curie temperature Tc and the thermal hysteresis $T_{hy}$ are determined from differential scanning calorimetry (DSC) zero field measurements. The magnetic entropy change $\Delta S_m$ is derived from the magnetization measurements using the Maxwell relation. The volume change of the elementary cell during the magnetic phase transition is determined from X-ray diffraction patterns as a function of temperature in a temperature range around $T_C$ in zero field.

Preferred magnetocaloric materials of the present invention exhibit a magnetic phase transition of first order nature (first order magnetoelastic transition FOMT). The first order nature of the magnetic phase transition is evidenced by a more than linear variation of the magnetization upon application of an external magnetic field in the vicinity of the Curie temperature Tc.

A further aspect of the present invention relates to a process for preparing a magnetocaloric material as described above, said process comprising the steps of (a) providing a mixture of precursors comprising atoms of the elements iron, manganese, phosphor, silicon and optionally carbon (b) reacting the mixture provided in step (a) to obtain a solid reaction product, comprising (b-1) reacting the mixture provided in step (a) in the solid phase obtaining a solid reaction product and/or (b-2) transferring the mixture provided in step (a) or the solid reaction product obtained in step (b-1) into the liquid phase and reacting it in the liquid phase obtaining a liquid reaction product, and transferring the liquid reaction product into the solid phase obtaining a solid reaction product, and (c) optionally shaping of the solid reaction product obtained in step (b) to obtain a shaped solid reaction product, and (d) optionally exposing the solid reaction product obtained in step (b) or the shaped solid reaction product obtained in step (c) to an atmosphere comprising one or more hydrocarbons to obtain a carburized product (e) heat treatment of the solid reaction product obtained in step (b) or the shaped solid reaction product obtained in step (c) or the carburized product obtained in step (d) to obtain a heat treated product, (f) cooling the heat treated product obtained in step (e) to obtain a cooled product, and (g) optionally shaping of the cooled product obtained in step (f), with the proviso that at least one of the following conditions is fulfilled:

the mixture provided in step (a) comprises atoms of the elements iron, manganese, phosphor, silicon and carbon step (d) is performed.

In to the process according to the present invention, atoms of carbon are provided in the form of precursors comprising atoms of carbon in the mixture provided in step (a), and/or in the form of hydrocarbons in step (d). Accordingly, in the process according to the present invention, at least one of the following conditions has to be fulfilled:

the mixture provided in step (a) comprises precursors comprising atoms of the elements iron, manganese, phosphor, silicon and carbon step (d) is performed.

In certain processes according to the present invention, the mixture provided in step (a) comprises precursors comprising atoms of the elements iron, manganese, phosphor, silicon and carbon, and step (d) is performed.

In other processes according to the present invention, the mixture provided in step (a) comprises precursors comprising atoms of the elements iron, manganese, phosphor, silicon and not atoms of carbon, and step (d) is performed.

In other processes according to the present invention, the mixture provided in step (a) comprises precursors comprising atoms of the elements iron, manganese, phosphor, silicon and carbon, and step (d) is omitted.

In the mixture of precursors to be provided in step (a) the stoichiometric ratio of the total amounts of atoms of the elements manganese, iron, silicon and phosphorus and optionally carbon, boron and nitrogen is adjusted so that in said mixture of precursors the stoichiometric ratio of the total amounts of atoms of the elements manganese, iron, silicon and phosphorus corresponds to formula (I).

Optionally, the mixture provided in step (a) further comprises precursors comprising atoms of nitrogen and/or precursors comprising atoms of boron.

In the mixture of precursors, manganese, iron, phosphorus, silicon, carbon (if present) and boron (if present) occur in elemental form and/or in the form of one or more compounds comprising one or more of said elements, preferably one or more compounds consisting of two or more of said elements. If nitrogen is present in the mixture of precursors, nitrogen is preferably present in the form of one or more compounds wherein nitrogen has a negative oxidation number.

The mixture of precursors to be provided in step (a) preferably comprises one more substances selected from the group consisting of elemental manganese, elemental iron, elemental silicon, elemental phosphorus, phosphides of iron, phosphides of manganese, and optionally one or more of elemental carbon, carbides of iron, carbides of manganese, carbonizable organic compounds, elemental boron, nitrides of iron, borides of iron, borides of manganese, ammonia gas and nitrogen gas.

A particularly preferred mixture of precursors comprises or consists of manganese, iron, red phosphorus, silicon, and one or more of elemental carbon and carbonizable organic compounds.

Elemental carbon may be selected from the group consisting of graphite and amorphous carbon. Carbon obtained from pyrolysis of carbonizable organic compounds is also a suitable precursor for providing carbon atoms. Carbonizable organic compounds are those which can be transferred into a product mainly consisting of carbon by pyrolysis (thermochemical cleavage of bonds under heat and non-oxidizing atmosphere, also referred to as charring). Alternatively, in step (a) carbonizable organic compounds are provided in the mixture of precursors, and pyrolyzed during step (b).

Step (a) is carried out by means of any suitable method. Preferably the precursors are powders, and/or the mixture of precursors is a powder mixture. If necessary, the mixture is ground in order to obtain a microcrystalline powder mixture. Mixing may comprise a period of ball milling which also provides suitable conditions for reacting the mixture of precursors in the solid state in subsequent step (b) (see below).

In step (b) the mixture provided in step (a) is reacted in the solid and/or liquid phase. In certain processes according to the invention, reacting is carried out in the solid phase (b-1) over the whole duration of step (b) so that a solid reaction product is obtained. In other processes according to the invention, reacting is carried out exclusively in the liquid phase (b-2) so that a liquid reaction product is obtained which is transferred into the solid phase obtaining a solid reaction product. Alternatively, reacting according to step (b) comprises one or more periods wherein reacting is carried out in the solid phase and one or more periods wherein reacting is carried out in the liquid phase. In preferred cases the reacting in step (b) consists of a first period wherein reacting is carried out in the solid phase (b-1) followed by a second period wherein reacting is carried out in the liquid phase (b-2) obtaining a liquid reaction product which is transferred into the solid phase obtaining a solid reaction product. Preferably, step (b) is carried out under a protective gas atmosphere.

In a preferred process according to the present invention, in step (b-1) reacting of the mixture in the solid phase comprises ball-milling so that a solid reaction product in the form of a powder is obtained.

In another preferred process according to the present invention, in step (b-2) reacting of the mixture comprises reacting of the mixture in the liquid phase by melting together the mixture of precursors, e.g. in an induction oven, preferably under a protecting gas (e.g. argon) atmosphere and/or in a closed vessel. Step (b-2) also comprises transferring said liquid reaction product into the solid phase obtaining a solid reaction product. Transferring said liquid reaction product into the solid phase is carried out by means of any suitable method, e.g. by quenching, melt-spinning or atomization.

Quenching means cooling of the liquid reaction product obtained in step (b-2) in such manner that the temperature of said liquid reaction product decreases faster than it would decrease in contact with resting air.

The technique of melt-spinning is known in the art. In melt spinning the liquid reaction product obtained in step (b-2) is sprayed onto a cold rotating metal roll or drum. Typically the drum or roll is made from copper. Spraying is achieved by means of elevated pressure upstream of the spray nozzle or reduced pressure downstream of the spray nozzle. Typically the rotating drum or roll is cooled. The drum or roll preferably rotates at a surface speed of 10 to 40 m/s, especially from 20 to 30 m/s. On the drum or roll, the liquid composition is cooled at a rate of preferably from $10^2$ to $10^7$ K/s, more preferably at a rate of at least $10^4$ K/s, especially with a rate of from 0.5 to $2*10^6$ K/s. Preferably, melt spinning is carried out under a protecting gas (e.g. argon) atmosphere. Melt spinning enables a more homogeneous element distribution in the obtained reaction product which leads to an improved magnetocaloric effect.

Atomization corresponds to mechanical disintegration of the liquid reaction product obtained in step (b-2) into small droplets, e.g. by means of a water jet, an oil jet, a gas jet, centrifugal force or ultrasonic energy. The droplets solidify and are collected on a substrate.

In a preferred process according to the present invention, in step (b-2) transferring the obtained liquid reaction product into the solid phase is carried out by quenching, meltspinning or atomization.

In step (b), any carbonizable organic compounds present in the mixture of precursors provided in step (a) are pyrolyzed, i.e. transferred into carbon.

Step (c) is carried out by means of any suitable method. For instance, when the reaction product obtained in step (b) is a powder, in step (c) said powder obtained in step (b) is shaped by pressing, molding, rolling, extrusion (especially hot extrusion) or metal injection molding.

Step (d) is performed in a manner similar to the commonly known gas carburization of iron alloys, especially of steel. The hydrocarbons used in step (d) are preferably selected from the group consisting of methane, propane and acetylene. Preferably, the atmosphere to which the solid reaction product obtained in step (b) or the shaped solid reaction product obtained in step (c) is exposed further comprises an inert gas, e.g. argon.

When the solid reaction product obtained in step (b) or the shaped solid reaction product obtained in step (c) is in the form of particles having a size of 100 μm or less, or even 10 μm or less, step (d) allows to obtain a product (carburized product) having a relatively homogeneous loading of carbon, since under usual carburization conditions the depth of diffusion of carbon is in the range of several millimeters.

Carburized iron alloys are mechanically stronger and more corrosion resistant, compared to their non-carburized precursors. It is believed that for the magnetocaloric materials of the present invention step (d) has a similar advantageous effect.

Step (e) is carried out by means of any suitable method. In step (e) the maximum temperature to which the solid reaction product obtained in step (b) or the shaped solid reaction product obtained in step (c) or the carburized product obtained in step (d) is exposed is below its melting temperature. Step (e) is performed in order to cure structural defects and to thermodynamically stabilize the reaction product obtained in step (b) or the carburized product obtained in step (d), and/or to strengthen and compact the shaped solid reaction product obtained in step (c) by fusing together the material grains.

Preferably, in step (e) the heat treatment comprises sintering the solid reaction product obtained in step (b) or the shaped solid reaction product obtained in step (c) or the carburized product obtained in step (d), preferably under a protective gas atmosphere.

Particularly preferably, in step (e) the heat treatment is carried out at temperatures in the range of from 900° C. to 1250° C., preferably of from 950° C. to 1150° C. and most preferably of from 1025° C. to 1125° C., preferably for a duration of from 1 hour to 30 hours, preferably from 5 hours to 25 hours, most preferably of from 10 hours to 20 hours.

In particularly preferred processes according to the present invention, wherein step (b) involves melt-spinning, a duration of the heat treatment of 5 hours or less is sufficient, because melt spinning provides for a rather homogeneous element distribution in the obtained reaction product.

In particularly preferred processes according to the present invention, in step (e) the heat treatment includes sintering the solid reaction product obtained in step (b) or the shaped solid reaction product obtained in step (c) or the carburized product obtained in step (d) at a temperature in the range of from 1000° C. to 1200° C.

optionally annealing of the sintered product at a temperature in the range of from 750° C. to 950° C.

cooling down of the sintered and optionally annealed product to room temperature with cooling rates up to 100 K/s optionally re-heating the cooled product and re-sintering at a temperature in the range of from 1000° C. to 1200° C.

Further preferably in step (e) the heat treatment includes sintering the solid reaction product obtained in step (b) or the shaped solid reaction product obtained in step (c) or the carburized product obtained in step (d) at a temperature in the range of from 1000° C. to 1200° C.

annealing of the sintered product at a temperature in the range of from 750° C. to 950° C.

cooling down of the sintered and annealed product to room temperature with cooling rates up to 100 K/s re-heating the cooled product and re-sintering at a temperature in the range of from 1000° C. to 1200° C.

In this preferred mode of carrying out step (e), during the stage of sintering the material grains are fused together so that the cohesion between the material grains of the shaped solid reaction product is increased and the porosity is reduced, and during the stage of annealing, the crystal structure is homogenized and crystal defects are cured.

Within step (e), cooling down of the sintered and optionally annealed product may be carried out by turning off the oven (known to the specialist as "oven cooling").

Step (f) is carried out by means of any suitable method. In a preferred process according to the present invention, step (f) includes contacting the heat treated product obtained in step (f) with a liquid or gaseous medium, preferably at a quenching rate of 200 K/s or less, preferably 100 K/s or less, most preferably 25 K/s.

Particularly preferably, quenching is carried out by means of contacting the heat treated product obtained in step (e) with water or aqueous liquids, for example cooled water or ice/water mixtures. For example, the heat treated product obtained in step (e) is allowed to fall into ice-cooled water. It is also possible to quench the heat treated product obtained in step (e) with sub-cooled gases such as liquid nitrogen or liquid argon.

Step (g) is carried out by means of any suitable method. For instance, when the cooled product obtained in step (f) is in a shape not suitable for the desired technical application (e.g. in the form of a powder), in step (f) said cooled product obtained in step (f) is transferred into a shaped body by means of pressing, molding, rolling, extrusion (especially hot extrusion) or metal injection molding. Alternatively, the cooled product obtained in step (f) which is in the form of a powder or has been transferred into the form of a powder is mixed with a binding agent, and said mixture is transferred into a shaped body in step (g). Suitable binding agents are oligomeric and polymeric binding systems, but it is also possible to use low molecular weight organic compounds, for example sugars. The shaping of the mixture is achieved preferably by casting, injection molding or by extrusion. The binding agent either remains in the shaped body or is removed catalytically or thermally so that a porous body with monolith structure is or a mesh structure formed.

Preferred processes according to the present invention are those which exhibit two or more of the above-defined preferred features in combination.

In a further aspect, the present invention relates to the use of a magnetocaloric material according to the present invention in a device selected from the group consisting of cooling systems, heat exchangers, heat pumps, thermomagnetic generators and thermomagnetic switches. Preferably, said magnetocaloric material is one of the preferred magnetocaloric materials described above, preferably a magnetocaloric material having a composition according to any of formula (I)-(XI) described above.

In a further aspect, the present invention relates to a device selected from the group consisting of cooling systems, heat exchangers, heat pumps, thermomagnetic generators and thermomagnetic switches, wherein said device comprises at least one magnetocaloric material according to the present invention. Preferably, said magnetocaloric material is one of the preferred magnetocaloric materials described above, preferably a magnetocaloric material having a composition according to any of formula (I)-(XI) described above.

The present invention is hereinbelow further illustrated by the following examples. Examples Preparation of Magnetocaloric Materials by Ball-Milling Step (a)

For the preparation of magnetocaloric materials according to the present invention, in each case 15 g of a precursor mixture consisting of the precursors elemental manganese, elemental iron, elemental red phosphorus, elemental silicon and graphite, and optionally one or both of iron nitride and elemental boron (each in the form of a powder) was provided. For the preparation of comparison materials not according to the present invention, the precursor mixture did not contain graphite.

Step (b-1)

Magnetocaloric materials according to the present invention were prepared by reacting the mixtures provided in step (a) in the solid phase using a planetary ball mill (Fritsch Pulverisette) with four grinding bowl fasteners. Each grinding bowl (80 ml volume) contains seven balls (10 mm diameter) made of tungsten carbide and 15 grams of a mixture of precursors prepared in step (a). The mixtures were ball milled for 10 hours with a constant rotation speed of 380 rpm in an argon atmosphere. (The total time in the ball mill is 16.5 hours, the machine stops milling for 10 minutes after every 15 minutes of milling).

Step (c)

After ball-milling the obtained reaction product which is in the form of a powder was compacted to small tablets (diameter 12 mm, height 5-10 mm) in a hydraulic pressing system with a pressure of 1.47 kPa (150 kgf $cm^{-2}$).

Step (e)

After pressing, the tablets were sealed inside quartz ampoules in an argon atmosphere of 20 kPa (200 mbar). Then, the samples were sintered at 1100° C. for 2 h and annealed at 850° C. for 20 h. The annealed samples were cooled down slowly to room temperature by turning off the oven (known to the specialist as "oven cooling") and thereafter re-sintered at 1100° C. for 20 h to achieve a homogeneous composition.

Step (f)

The thermal treatment of step (e) was finished by contacting the ampoules with water.

The composition of magnetocaloric materials prepared in the above-described manner and the composition of the corresponding precursor mixtures (weight of each precursor in g) is given in tables 1-4 below:

TABLE 1

| $Mn_{1.25}Fe_{0.7}P_{0.5}Si_{0.5}C_z$ | Mn/[g] | Fe/[g] | P/[g] | Si/[g] | C/[g] |
|---|---|---|---|---|---|
| z = 0.00 | 7.5027 | 4.2710 | 1.6919 | 1.5342 | 0.0000 |
| z = 0.05 | 7.4700 | 4.2524 | 1.6846 | 1.5275 | 0.0653 |
| z = 0.10 | 7.4376 | 4.2340 | 1.6773 | 1.5209 | 0.1300 |
| z = 0.15 | 7.4055 | 4.2157 | 1.6700 | 1.5143 | 0.1942 |

TABLE 2

| $Mn_{1.25}Fe_{0.7}P_{0.6}Si_{0.4}C_z$ | Mn/[g] | Fe/[g] | P/[g] | Si/[g] | C/[g] |
|---|---|---|---|---|---|
| z = 0.00 | 7.4869 | 4.2620 | 2.0261 | 1.2248 | 0.000 |
| z = 0.05 | 7.4544 | 4.2435 | 2.0173 | 1.2194 | 0.0651 |
| z = 0.10 | 7.4221 | 4.2251 | 2.0086 | 1.2142 | 0.1298 |
| z = 0.15 | 7.3902 | 4.2069 | 1.9994 | 1.2089 | 0.1938 |

TABLE 3

| $Mn_{1.25}Fe_{0.7}P_{0.5}Si_{0.5}N_{0.03}C_z$ | Mn/[g] | Fe/[g] | $Fe_xN$/[g] | P/[g] | Si/[g] | C/[g] |
|---|---|---|---|---|---|---|
| z = 0.00 | 7.4798 | 3.7653 | 0.5384 | 1.6868 | 1.5295 | 0.0000 |
| z = 0.05 | 7.4473 | 3.7489 | 0.5361 | 1.6795 | 1.5229 | 0.0651 |
| z = 0.10 | 7.4151 | 3.7324 | 0.5338 | 1.6722 | 1.5163 | 0.1296 |
| z = 0.15 | 7.3832 | 3.7166 | 0.5315 | 1.6650 | 1.5097 | 0.1937 |

TABLE 4

| $MnFe_{0.95}P_{0.595-r}Si_{0.33}B_{0.075}C_{0.05}N_r$ | Mn/[g] | Fe/[g] | Iron nitride/[g] | P/[g] | Si/[g] | C/[g] | B/[g] |
|---|---|---|---|---|---|---|---|
| r = 0.00 | 6.0106 | 5.8046 | 0.0000 | 2.0163 | 1.0140 | 0.0657 | 0.0887 |
| r = 0.02 | 6.0011 | 5.4659 | 0.3600 | 2.0063 | 1.0124 | 0.0656 | 0.0886 |

Preparation of Magnetocaloric Materials by Melt-Spinning

Step (a)

For the preparation of magnetocaloric materials according to the present invention, in each case a precursor mixture consisting of the precursors elemental manganese, elemental iron, elemental red phosphorus, elemental silicon and graphite, was provided. For the preparation of a comparison material not according to the present invention, the precursor mixture did not contain graphite.

Step (b-1)

The precursor mixture was grinded by ball milling in tungsten-carbide jars (V≈380 ml) with tungsten-carbide balls (m≈8 g) under argon atmosphere. A ball-milling time of 10 hours and rotation speed of 360 rpm. The fine powders obtained after ball milling were pressed into tablets.

Step (b-2)

The tablets obtained from step (B-1) were molten to obtain a liquid reaction product. The obtained liquid reaction product is transferred into the solid phase by melt-spinning. The surface velocity of the copper wheel was about 45 m/s.

Step (e)

The solid product (ribbons or flakes) prepared by melt spinning were sealed in quartz ampoules in argon atmosphere of 200 mbar. The sealed samples were sintered at 1373 K for 2 h.

Step (f)

The thermal treatment of step (e) was finished by contacting the ampoules with water.

The obtained materials had the following composition: $MnFe_{0.95}P_{0.67}Si_{0.33}$ (comparison material not according to the present invention), $MnFe_{0.95}P_{0.67}Si_{0.33}C_{0.05}$ and $MnFe_{0.95}P_{0.67}Si_{0.33}C_{0.1}$.

Determination of Magnetocaloric Properties

Before the measurements, the samples were precooled in liquid nitrogen to remove the virgin effect. Then the samples were manually crushed by means of a mortar to prepare powders for the measurements.

A differential scanning calorimeter (DSC) equipped with a liquid nitrogen cooling system was used to measure the specific heat. The measurements were conducted with a swept rate of 10 K/min. The Curie temperatures Tc and thermal hysteresis LThys and the were determined from DSC zero field measurements (heating and cooling curves). Magnetization measurements were performed using the Reciprocating Sample Option (RSO) mode in a Superconducting Quantum Interference Device (SQUID) magnetometer (Quantum Design MPMS 5XL). Temperature dependent magnetization in the vicinity of the Curie temperature was measured in 0.05, 0.2, 0.4, 0.6, 0.8, 1.0, 1.2, 1.4, 1.6, 1.8 and 2.0 Tin cooling and heating mode with a sweep rate of 2K/min. The magnetic entropy change ΔSm is derived from the magnetization measurements in heating mode using the Maxwell relations.

FIGS. 1A to 1D show the temperature dependence of the specific magnetization (magnetization per mass) recorded on cooling and heating (sweeping rate 2 k/min) in a magnetic field of 1 T for materials the materials according to tables 1-4.

Figure 2:
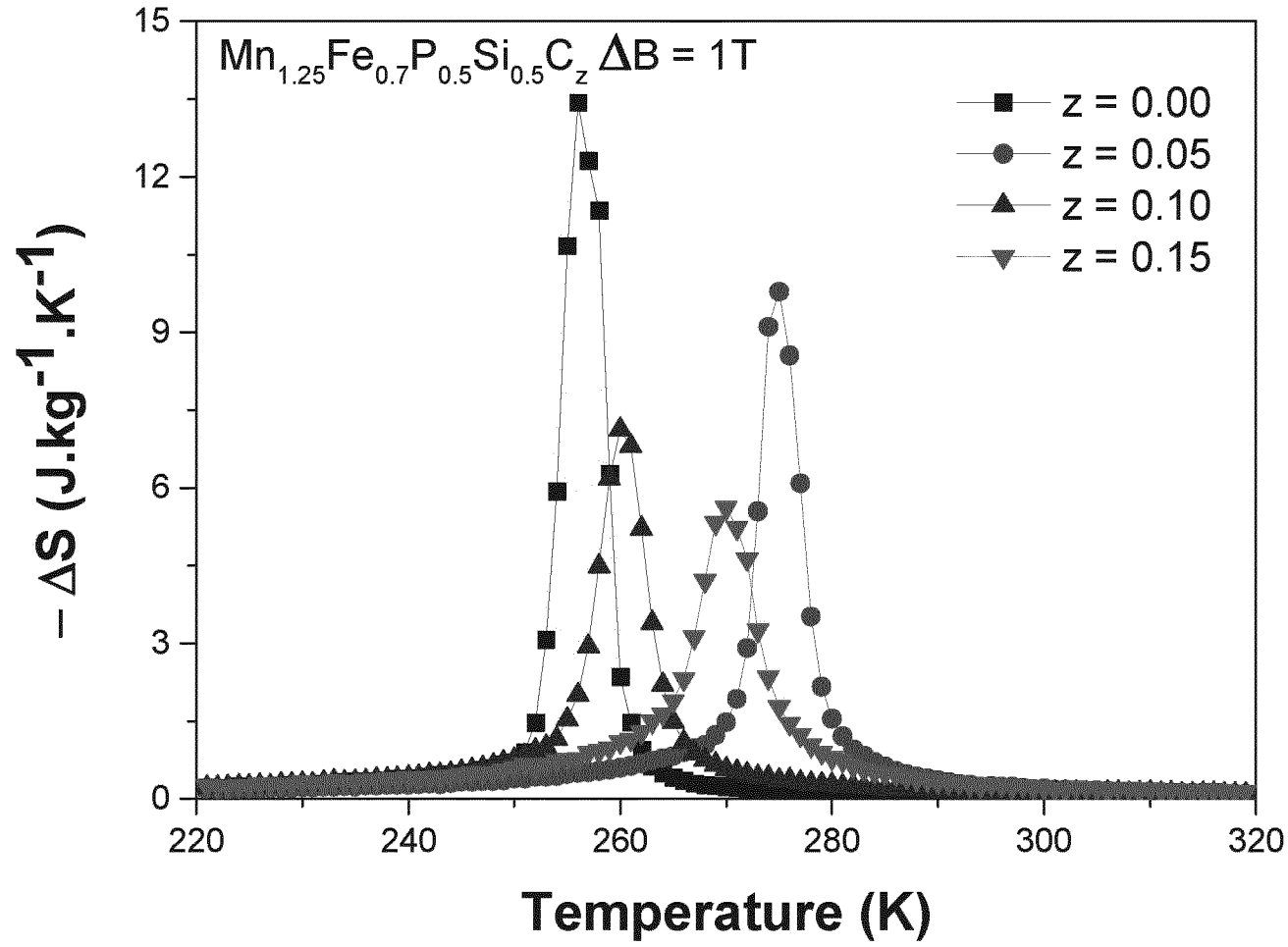
Figure 3A:
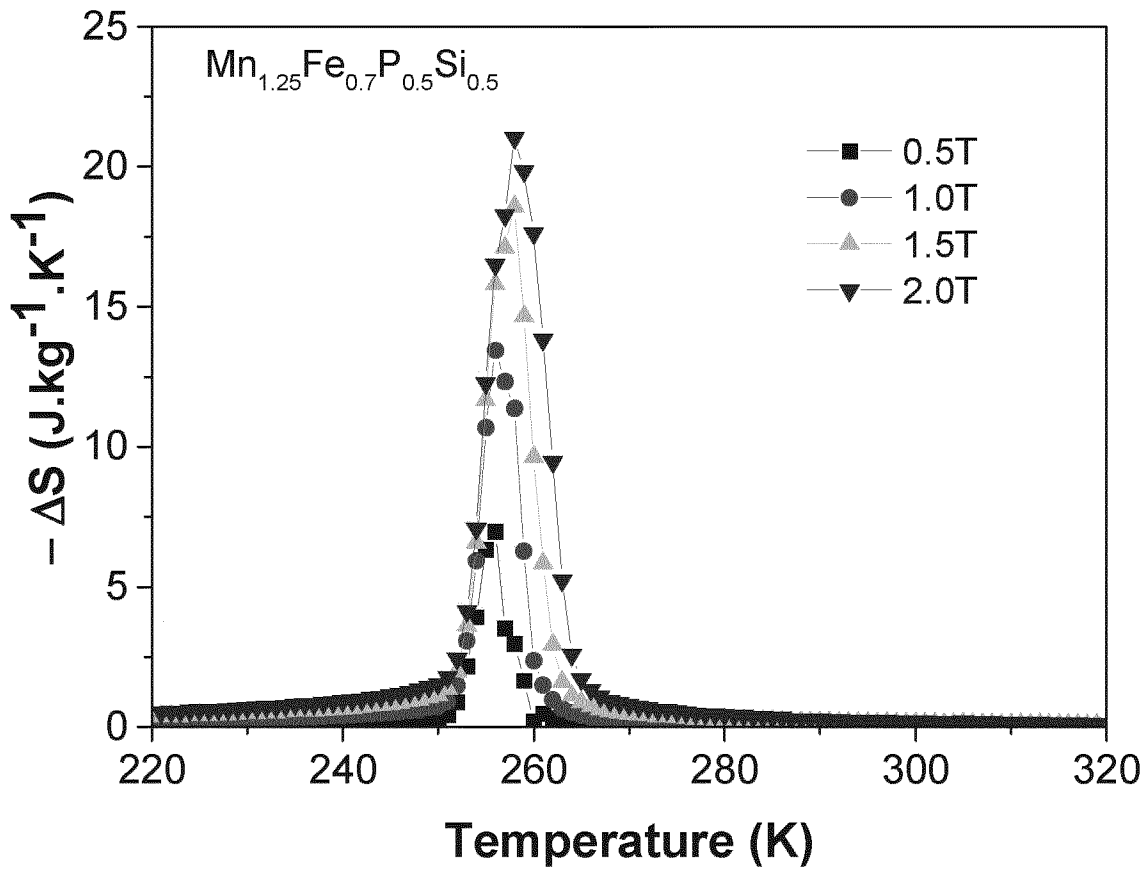
Figure 3B:
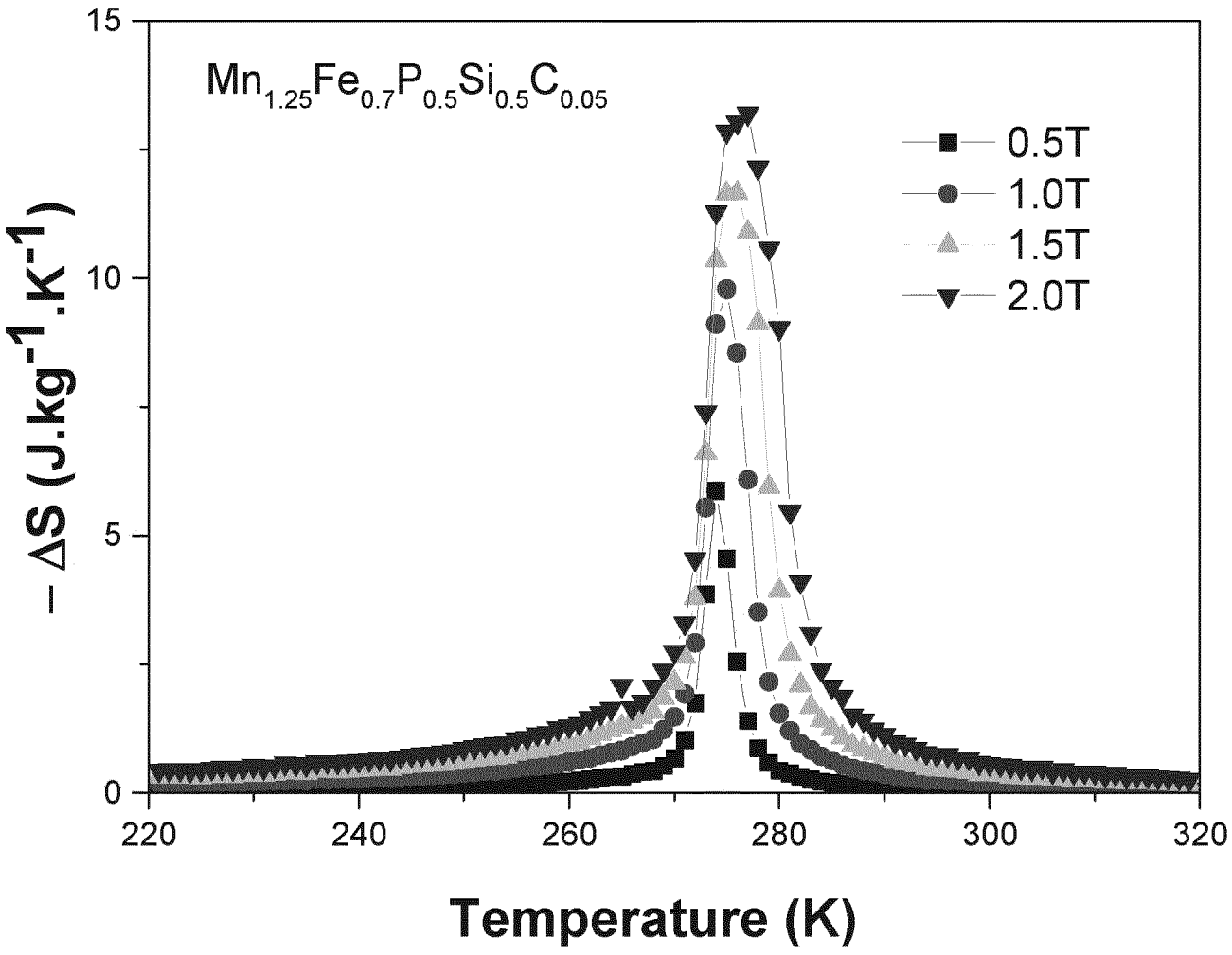
Figure 3C:
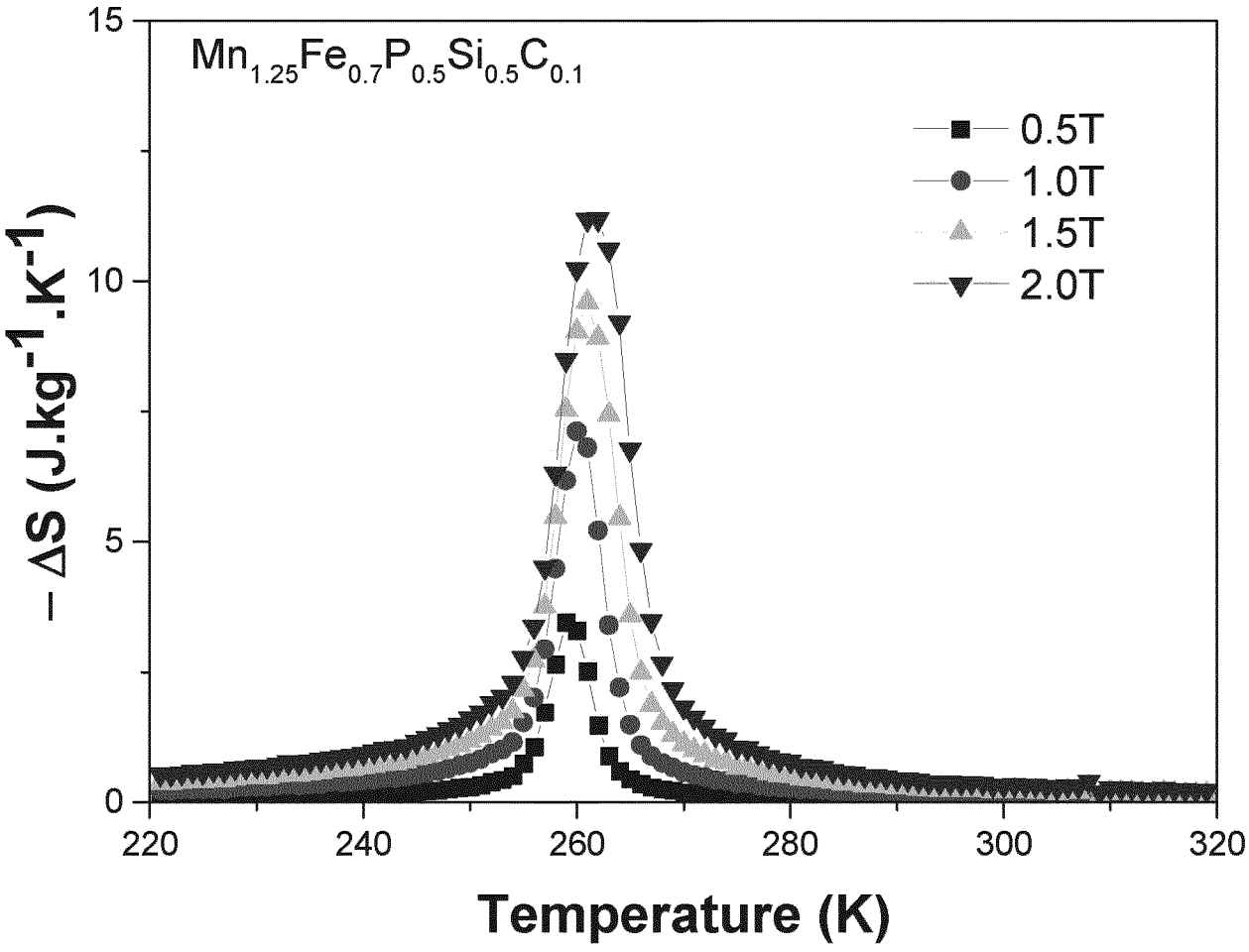
Figure 3D:
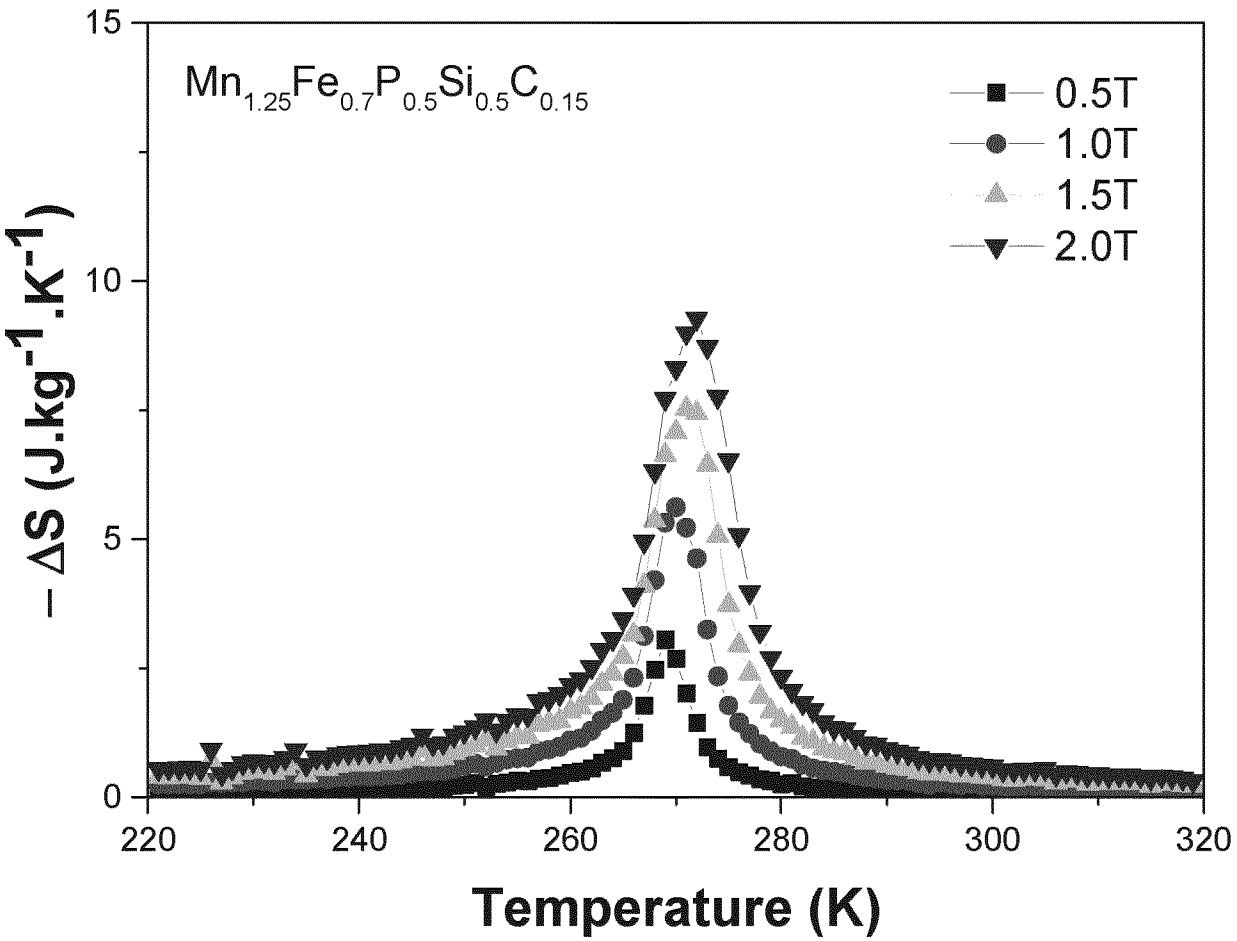

FIG. 2 shows for all the materials of table 1 the magnetic entropy change ΔSm at a field change of 1 T FIGS. 3A to 3D show the magnetic entropy change ΔSm at a field change of 0.5 T, 1 T, 1.5 T and 2 T for each of the individual materials of table 1.

Figure 4A:
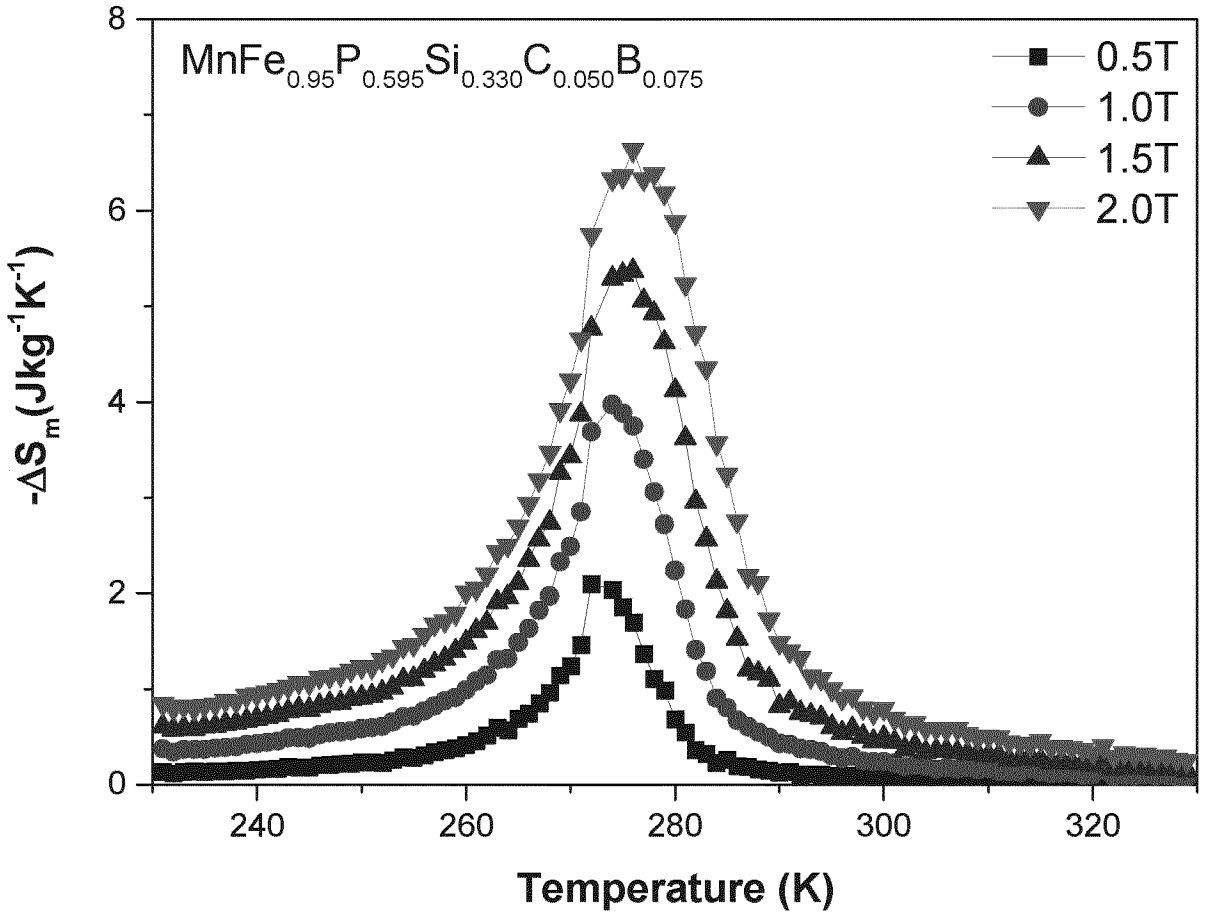
Figure 4B:
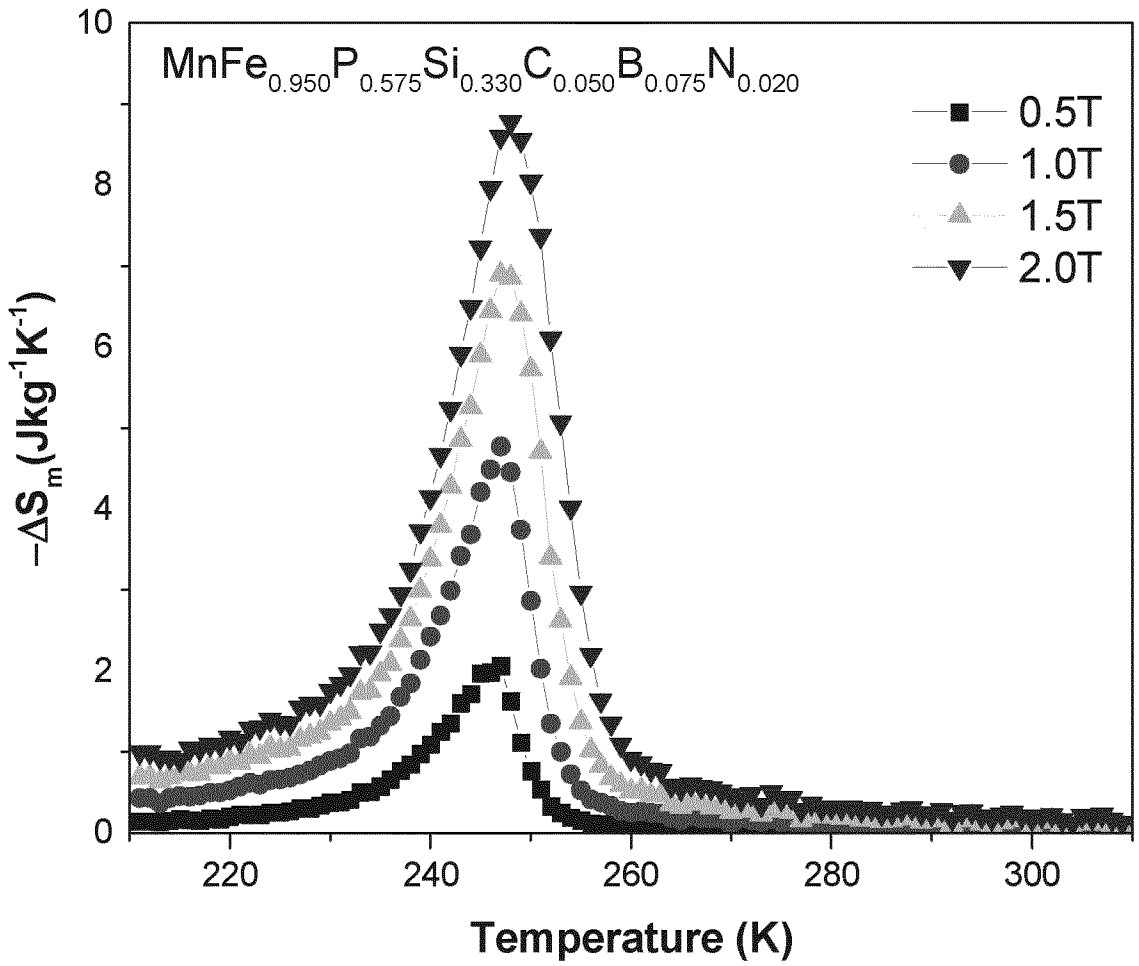

FIGS. 4A and 4B show the magnetic entropy change ΔSm at a field change of 0.5 T, 1 T, 1.5 T and 2 T for each material of table 4.

Figure 5A:
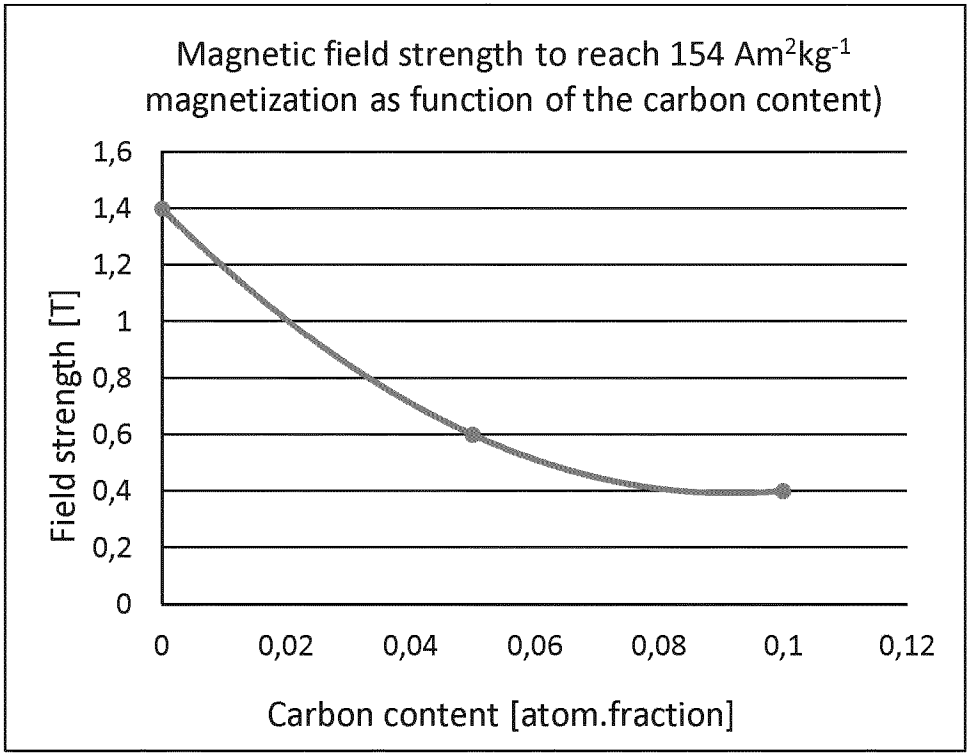
Figure 5B:
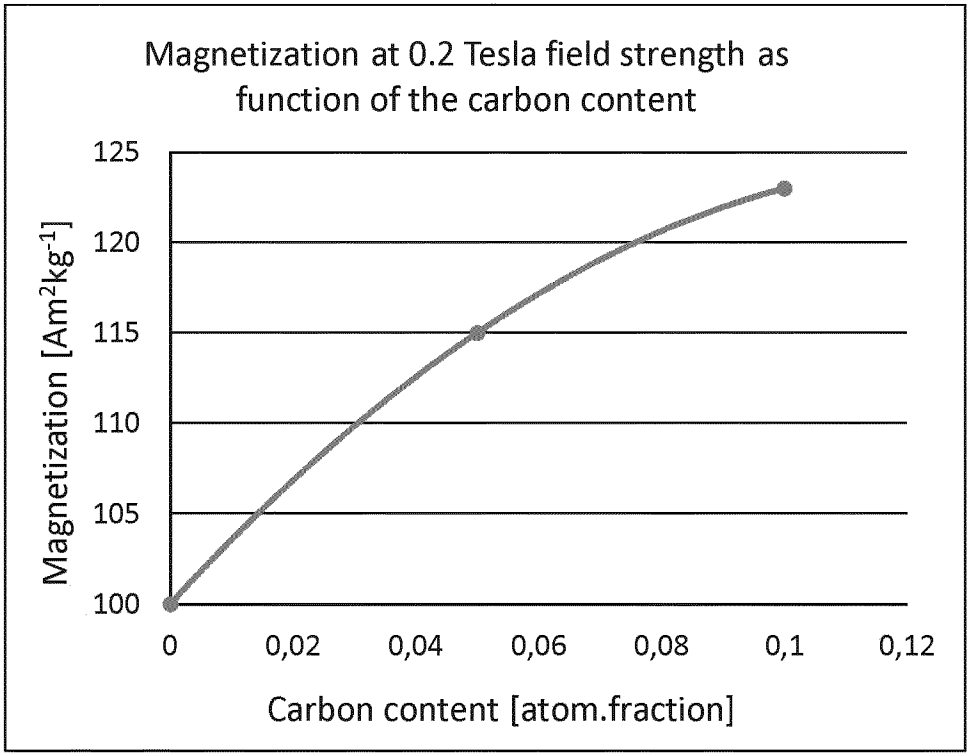

FIG. 5A shows for the melt-spun materials $MnFe_{0.95}P_{0.67}Si_{0.33}$, $MnFe_{0.95}P_{0.67}Si_{0.33}C_{0.05}$ and $MnFe_{0.95}P_{0.67}Si_{0.33}C_{0.01}$ that the magnetic field strength needed to reach a specific magnetization of 154 $Am^2/kg$ decreases with increasing carbon content. FIG. 5B shows for the same materials that the specific magnetization achieved at a field strength of 0.2 T increases with increasing carbon content. Accordingly, magnetocaloric materials which comprise carbon in addition to manganese, iron, phosphorus and silicon reach the same specific magnetization at a lower magnetic field strength, compared to magnetocaloric materials which comprise manganese, iron, silicon, phosphorus and no carbon.

The parameters Curie temperature Tc, thermal hysteresis ΔThys and magnetic entropy change ΔSm (if measured) of the materials according to tables 1-4 are listed in tables 5-8 below:

TABLE 5

| | $T_C$/[K] | | | $\Delta S_m$/[Jkg$^{-1}$K$^{-1}$] | | | |
|---|---|---|---|---|---|---|---|
| $Mn_{1.25}Fe_{0.7}P_{0.5}Si_{0.5}C_z$ | cooling | heating | $\Delta T_{hys}$/[K] | 0.5 T | 1.0 T | 1.5 T | 2.0 T |
| z = 0.00 | 257.6 | 262.2 | 4.6 | 6.97 | 13.43 | 18.56 | 21.01 |
| z = 0.05 | 276.7 | 277.2 | 0.5 | 5.88 | 9.79 | 11.65 | 13.02 |
| z = 0.10 | 259.6 | 263.1 | 3.5 | 3.46 | 7.12 | 9.60 | 11.19 |
| z = 0.15 | 269.9 | 271.2 | 1.3 | 3.05 | 5.61 | 7.53 | 9.21 |

TABLE 6

| | $T_c$/[K] | | |
|---|---|---|---|
| $Mn_{1.25}Fe_{0.7}P_{0.5}Si_{0.5}N_{0.03}C_z$ | cooling | heating | $\Delta T_{hys}$/[K] |
| z = 0.00 | 216.8 | 228.5 | 11.7 |
| z = 0.05 | 239.7 | 247.1 | 7.4 |
| z = 0.10 | 229.7 | 238.1 | 8.4 |
| z = 0.15 | 229.8 | 239.2 | 9.4 |

TABLE 7

| | $T_c$ (K) | | |
|---|---|---|---|
| $Mn_{1.25}Fe_{0.7}P_{0.6}Si_{0.4}C_z$ | cooling | heating | $\Delta T_{hys}$ (K) |
| z = 0.00 | 120.8 | 156.2 | 35.4 |
| z = 0.05 | 128.5 | 154.2 | 21.0 |
| z = 0.10 | 147.5 | 168.5 | 25.7 |
| z = 0.15 | 130.8 | 159.1 | 28.3 |

TABLE 8

| | $T_C$/[K] | | | $\Delta S_m$/[Jkg$^{-1}$K] | | | |
|---|---|---|---|---|---|---|---|
| $MnFe_{0.95}P_{0.595-r}Si_{0.33}B_{0.075}C_{0.05}N_r$ | cooling | heating | $\Delta T_{hys}$/[K] | 0.5 T | 1.0 T | 1.5 T | 2.0 T |
| r = 0.00 | 274.9 | 276.3 | 1.4 | 2.1 | 4.0 | 5.4 | 6.6 |
| r = 0.02 | 243.7 | 248.2 | 4.5 | 2.1 | 4.8 | 6.9 | 8.8 |

It is concluded from tables 5-8 that the presence of carbon, and optionally one or both boron and nitrogen allows to adjust the parameters Curie temperature Tc, thermal hysteresis ΔThys and magnetic entropy change ΔSm, relative to the corresponding parent material consisting of iron, manganese, phosphorus and silicon.

FIG. 5A shows for the melt-spun materials $MnFe_{0.95}P_{0.67}Si_{0.33}$, $MnFe_{0.95}P_{0.67}Si_{0.33}C_{0.05}$ and $MnFe_{0.95}P_{0.67}Si_{0.33}C_{0.01}$ that the magnetic field strength needed to reach a specific magnetization of 154 $Am^2/kg$ decreases with increasing carbon content. FIG. 5B shows for the same materials that the specific magnetization achieved at a field strength of 0.2 T increases with increasing carbon content. Accordingly, magnetocaloric materials which comprise carbon in addition to manganese, iron, phosphorus and silicon reach the same specific magnetization at a lower magnetic field strength, compared to magnetocaloric materials which comprise manganese, iron, silicon, phosphorus and no carbon.

The invention claimed is:

1. A magnetocaloric material, which has a composition satisfying formula (I)

$$(Mn_xFe_{1-x})_{2+u}P_ySi_vC_zN_rB_w \quad (I)$$

wherein $-0.1 \le u \le 0.1$, $0.2 \le x \le 0.8$, $0.3 \le y \le 0.75$, $0.25 \le v \le 0.7$, $0.001 \le z \le 0.15$, $0 \le r \le 0.1$, $0 \le w \le 0.1$, $y+v+w \le 1.05$,and $y+v+w+r \ge 0.95$.

2. The magnetocaloric material of claim 1, which exhibits a hexagonal $Fe_2P$ crystalline structure of with a crystal lattice having the space group P-62m, wherein carbon atoms occupy interstitial sites of said crystal lattice, boron atoms, if present, occupy crystal sites of said crystal lattice, and nitrogen atoms, if present, occupy crystal sites and/or interstitial sites of said crystal lattice.

3. The magnetocaloric material of claim 2, wherein carbon atoms occupy interstitial sites selected from the group consisting of 6k and 6j sites.

4. The magnetocaloric material of claim 1, wherein $0.05 \le u \le 0.05$ $0.3 \le x \le 0.7$, $0.4 \le y \le 0.7$ $0.3 \le v \le 0.6$ $0.003 \le z \le 0.12$, $0 \le r \le 0.07$, $0 \le w \le 0.08$ $y+v+w \le 1.02$,and $y+v+w+r \ge 0.98$.

5. The magnetocaloric material of claim 1, wherein $-0.1 \le u \le 0.1$, $0.2 \le x \le 0.8$, $0.3 \le y \le 0.75$, $0.25 \leq v \leq 0.7$, $0.001 \leq z \leq 0.15$, and $0.95 \leq y+v \leq 1.05$.

6. The magnetocaloric material of claim 1, which is selected from the group consisting of $Mn_{1.25}Fe_{0.7}P_{0.5}Si_{0.5}C_{0.05}$, $Mn_{1.25}Fe_{0.7}P_{0.5}Si_{0.5}C_{0.1}$, $Mn_{1.25}Fe_{0.7}P_{0.5}Si_{0.5}C_{0.15}$, $Mn_{1.25}Fe_{0.7}P_{0.5}Si_{0.5}N_{0.03}C_{0.05}$, $Mn_{1.25}Fe_{0.7}P_{0.5}Si_{0.5}N_{0.03}C_{0.1}$, $Mn_{1.25}Fe_{0.7}P_{0.5}Si_{0.5}N_{0.03}C_{0.15}$, $Mn_{1.25}Fe_{0.7}P_{0.6}Si_{0.4}C_{0.05}$, $Mn_{1.25}Fe_{0.7}P_{0.6}Si_{0.4}C_{0.1}$, $Mn_{1.25}Fe_{0.7}P_{0.6}Si_{0.4}C_{0.15}$, $MnFe_{0.95}P_{0.67}Si_{0.33}C_{0.01}$, $MnFe_{0.95}P_{0.67}Si_{0.33}C_{0.02}$, $MnFe_{0.95}P_{0.67}Si_{0.33}C_{0.03}$, $MnFe_{0.95}P_{0.67}Si_{0.33}C_{0.05}$, $MnFe_{0.95}P_{0.67}Si_{0.33}C_{0.1}$, $MnFe_{0.95}P_{0.575}Si_{0.33}B_{0.075}O_{0.05}N_{0.02}$, $Mn_{1.18}Fe_{0.73}P_{0.48}Si_{0.52}C_{0.012}$, $Mn_{1.19}Fe_{0.73}P_{0.48}Si_{0.52}C_{0.032}$, and $Mn_{1.16}Fe_{0.75}P_{0.47}Si_{0.53}C_{0.06}$.

7. A process for preparing the magnetocaloric material of claim 1, said process comprising:

(a) providing a mixture of precursors comprising atoms of the elements iron, manganese, phosphorous, silicon and optionally one or more of carbon, nitrogen and boron, (b) reacting the mixture provided in (a) to obtain a solid reaction product, wherein (b) comprises (b-1) reacting the mixture provided in (a) in the solid phase and obtaining a solid reaction product and/or (b-2) transferring the mixture provided in (a) or the solid reaction product obtained in (b-1) into the liquid phase, reacting it in the liquid phase, obtaining a liquid reaction product, transferring the liquid reaction product into the solid phase, and obtaining a solid reaction product, (c) optionally shaping of the solid reaction product obtained in (b) to obtain a shaped solid reaction product, (d) optionally exposing the solid reaction product obtained in (b) or the shaped solid reaction product obtained in (c) to an atmosphere comprising one or more hydrocarbons to obtain a carburized product, (e) heat treating the solid reaction product obtained in (b), the shaped solid reaction product obtained in (c) or the carburized product obtained in (d) to obtain a heat treated product, (f) cooling the heat treated product obtained in (e) to obtain a cooled product, and (g) optionally shaping of the cooled product obtained in (f), with the proviso that at least one of the following conditions is fulfilled:

the mixture provided in (a) comprises atoms of the elements iron, manganese, phosphorous, silicon and carbon (d) is performed.

8. The process of claim 7, wherein said mixture of precursors comprises one or more substances selected from the group consisting of elemental manganese, elemental iron, elemental silicon, elemental phosphorus, an iron phosphide, a manganese phosphide, and optionally one or more of elemental carbon, an iron carbide, a manganese carbide, a carbonizable organic compound, elemental boron, an iron nitride, an iron boride, a manganese boride, ammonia gas and nitrogen gas.

9. The process of claim 7, wherein (b-1) comprises ball-milling so that a reaction product in the form of a powder is obtained.

10. The process of claim 7, wherein in (b-2) transferring the liquid reaction product into the solid phase is carried out by quenching, melt-spinning or atomization.

11. The process of claim 7, wherein the one or more hydrocarbons used in (d) are selected from the group consisting of methane, propane and acetylene.

12. The process of claim 7, wherein in (e) the heat treating comprises sintering the solid reaction product obtained in (b), the shaped solid reaction product obtained in (c) or the carburized product obtained in (d).

13. The process of claim 7, wherein in (e) the heat treating is carried out at a temperature in the range of from 900 to 1250° C.

14. A device, selected from the group consisting of a cooling system, a heat exchanger, a heat pump, a thermomagnetic generator and a thermomagnetic switch, wherein said device comprises the magnetocaloric material of claim 1.

* * * * *